US007014293B2

(12) United States Patent
Ikeda et al.

(10) Patent No.: US 7,014,293 B2
(45) Date of Patent: Mar. 21, 2006

(54) RECORDING APPARATUS

(75) Inventors: Yasuhiko Ikeda, Kanagawa (JP); Seiji Takahashi, Kanagawa (JP); Kota Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 10/646,893

(22) Filed: Aug. 25, 2003

(65) Prior Publication Data

US 2004/0041880 A1 Mar. 4, 2004

(30) Foreign Application Priority Data

Aug. 30, 2002 (JP) ..... 2002-253559

(51) Int. Cl.
*B41J 23/00* (2006.01)
*B41J 25/308* (2006.01)

(52) U.S. Cl. ..... 347/37; 347/8

(58) Field of Classification Search ..... 347/19, 347/8, 37, 20

See application file for complete search history.

(56) References Cited

U.S. PATENT DOCUMENTS 5,000,590 A 3/1991 Einem ..... 400/55
5,870,117 A 2/1999 Moore ..... 347/37
6,137,508 A * 10/2000 Gaarder ..... 347/50
6,629,787 B1 * 10/2003 Lee et al. ..... 400/59

FOREIGN PATENT DOCUMENTS

EP 1 174 276 1/2002

* cited by examiner

*Primary Examiner*—Thinh Nguyen
(74) *Attorney, Agent, or Firm*—Fitzpatrick, Cella, Harper & Scinto

(57) ABSTRACT

The object of the present invention is to provide a recording apparatus designed such that without the use of a complicated mechanism, a code strip can be moved following the position of a sensor on a carriage side, and for this purpose, the recording apparatus according to the present invention is provided with a carriage carrying thereon a recording head for effecting recording on a recording material, and reciprocally scanning along the recording material, a position detecting sensor provided on the carriage for detecting the position of the carriage, a code strip to be read by the position detecting sensor, a guide shaft providing a guide for the scanning of the carriage, and a guide shaft lifting mechanism for moving up and down the guide shaft to thereby change the height position of the carriage, and when the guide shaft is moved up and down, the carriage moves up and down the code strip.

6 Claims, 28 Drawing Sheets

(BEFORE INSTALLING CD CONVEYING PORTION)

(AFTER INSTALLING CD CONVEYING PORTION)

(STATE BEFORE INSTALLING CD CONVEYING PORTION)

(STATE AFTER INSTALLING CD CONVEYING PORTION AND MOVING SLIDE COVER)

(BEFORE MOVING SLIDE COVER)

(AFTER MOVING SLIDE COVER)

(ON MOVING DOWN CARRIAGE)

(ON MOVING UP CARRIAGE)

RECORDING APPARATUS

BACKGROUND OF THE INVENTION

1. Field of the Invention

This invention relates to a recording apparatus such as a printer, and particularly to a recording apparatus for effecting recording with the gap between a recording material and recording means such as a recording head changed properly when recording is to be effected on recording materials having various thicknesses.

2. Related Background Art

There have heretofore been various recording materials on which recording is effected by a recording apparatus such as a printer. They include compact and thick recording materials such as CD-R, DVD and cards. Hereinafter there will be collectively called a "compact disc" or "CD". When in the existing versatile printer, printing is to be effected on the aforementioned recording material, if a conveying path for slip paper (leaf paper) is used, there will arise the problems that (1) conveyability is not good due to rigidity, (2) injuries occur, and (3) conveyance cannot be done because of the distance between conveying rollers. So, these problems are coped with by using a tray and using a path differing from the conveying path for slip paper.

The tray has a greater thickness than ordinary slip paper and therefore, it is necessary to nip it between a pair of conveying rollers, and secure a gap between a recording head and a recording medium. As a means therefore, an operating lever is provided in the printer, and the pressing of a conveying member is released in operative association of the movement of the operating lever. A user then inserts the tray into a predetermined position and positions it, whereupon the user operates the operating lever and presses the conveying member. Further, the user elevates a carriage carrying the recording head thereon, by the operating lever, to thereby secure the gap between the recording head and the recording medium. Eccentric cams are provided on the opposite ends of a guide shaft for scanning the carriage, and the eccentric cams are operatively associated with the operation of the operating lever. Also, the rotated position of the eccentric cams is detected by the use of a sensor or the like to thereby detect a plurality of stages of gap positions.

Also, it is practiced to effect printing without particularly effecting the detection of the position of the recording medium such as the CD, or to directly detect the position of a white portion within a CD printing range by a sensor carried on the carriage, and effect printing.

The above-described example of the prior art, however, has suffered from the following problems.

In the case of a construction in which the position of the carriage is accurately grasped to thereby improve the accuracy of printing, a linear sensor provided on the carriage side is often used to detect the number of the bars of a code strip on which a plurality of bars are printed, during the scanning of the carriage, to thereby detect the position of the carriage.

When in such a construction, the eccentric cams on the opposite ends of the guide shaft are rotated to thereby move up and down the carriage with the guide shaft, if the amount of change in the ordinary printing height of the carriage and the printing height when the carriage has been moved uppermost is great, the code strip comes off from the sensor for detecting the position of the carriage and it becomes impossible to detect the position of the carriage.

In order to avoid this problem, use has been made of a mechanism for raising the opposite ends of the code strip in conformity with the upward movement of the guide shaft, but this requires many parts, and not only has increased costs, but also has complicated the mechanism and has sometimes spoiled the reliability of the apparatus.

SUMMARY OF THE INVENTION

It is the object of the present invention to provide a recording apparatus designed such that without the use of any complicated mechanism, a code strip cam move following the position of a sensor on a carriage side.

The present invention is characterized by the provision of a carriage carrying thereon a recording head for effecting recording on a recording material, and reciprocally scanning along the recording material, a position detecting sensor provided on the carriage for detecting the position of the carriage, a code strip to be read by the position detecting sensor, a guide shaft providing a guide for the scanning of the carriage, and a guide shaft lifting mechanism for moving up and down the guide shaft to thereby change the height position of the carriage, the carriage moving up and down the code strip when the guide shaft is moved up and down.

According to the present invention, design is made such that when the height of the recording head relative to the recording surface of the recording material is to be changed in order to change the recording material from plain paper to a CD or the like, when the guide shaft for scanning the carriage is moved up and down by guide shaft lifting means to thereby change the height position of the carriage, the carriage moves up and down the code strip and causes it follow the position of the position detecting means of the carriage for reading the code strip. Therefore, no additional part and complicated mechanism are required for moving up and down the code strip, and irrespective of the height position of the carriage, the position detecting means can read the code strip.

DESCRIPTION OF THE PREFERRED EMBODIMENTS

Figure 1:
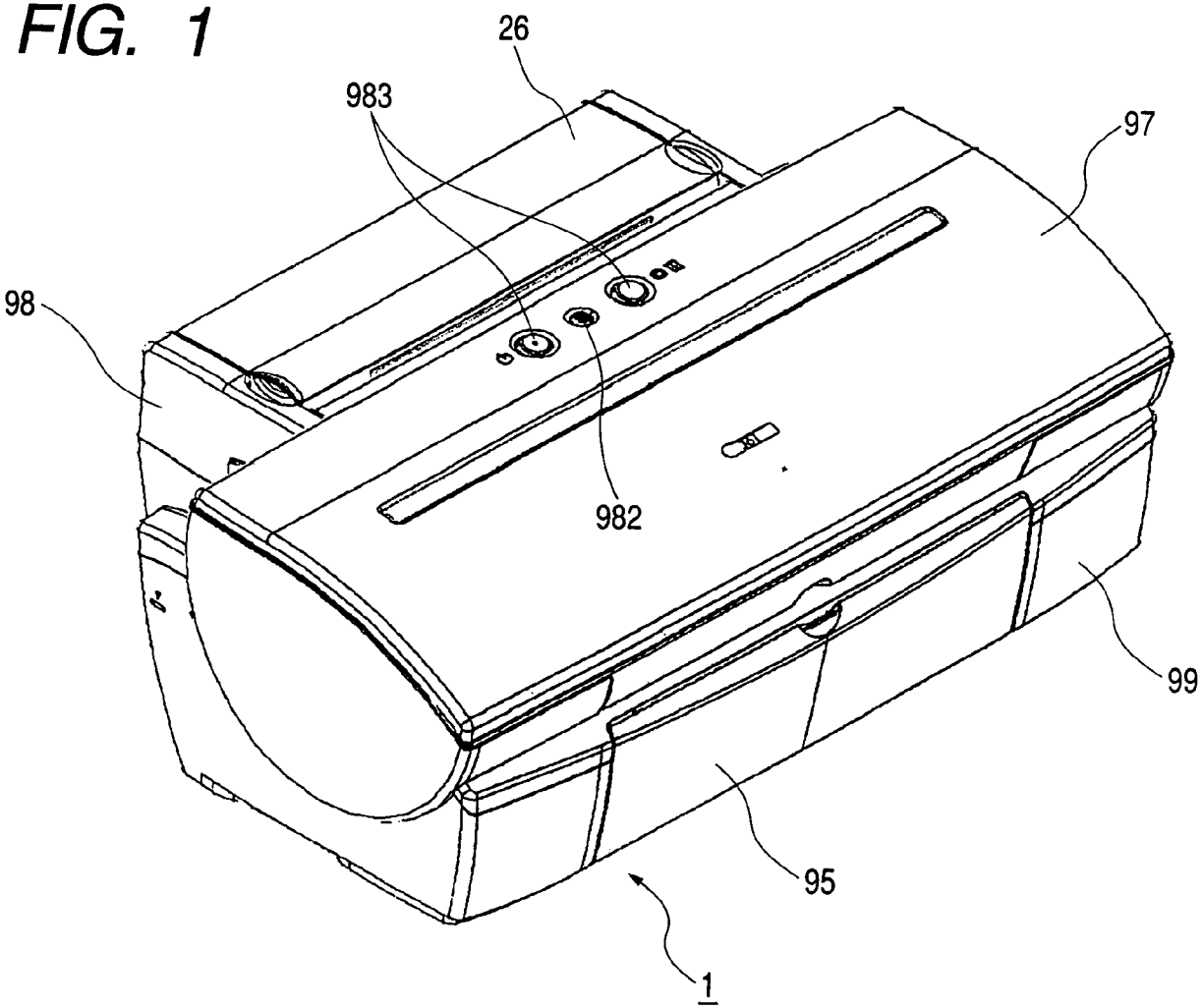
FIG. 1 is a perspective view showing an embodiment of a recording apparatus to which the present invention is applied.

An embodiment of the present invention will hereinafter be described in detail with reference to the drawings. Throughout the drawings, like reference characters designate like or corresponding portions.

Figure 2:
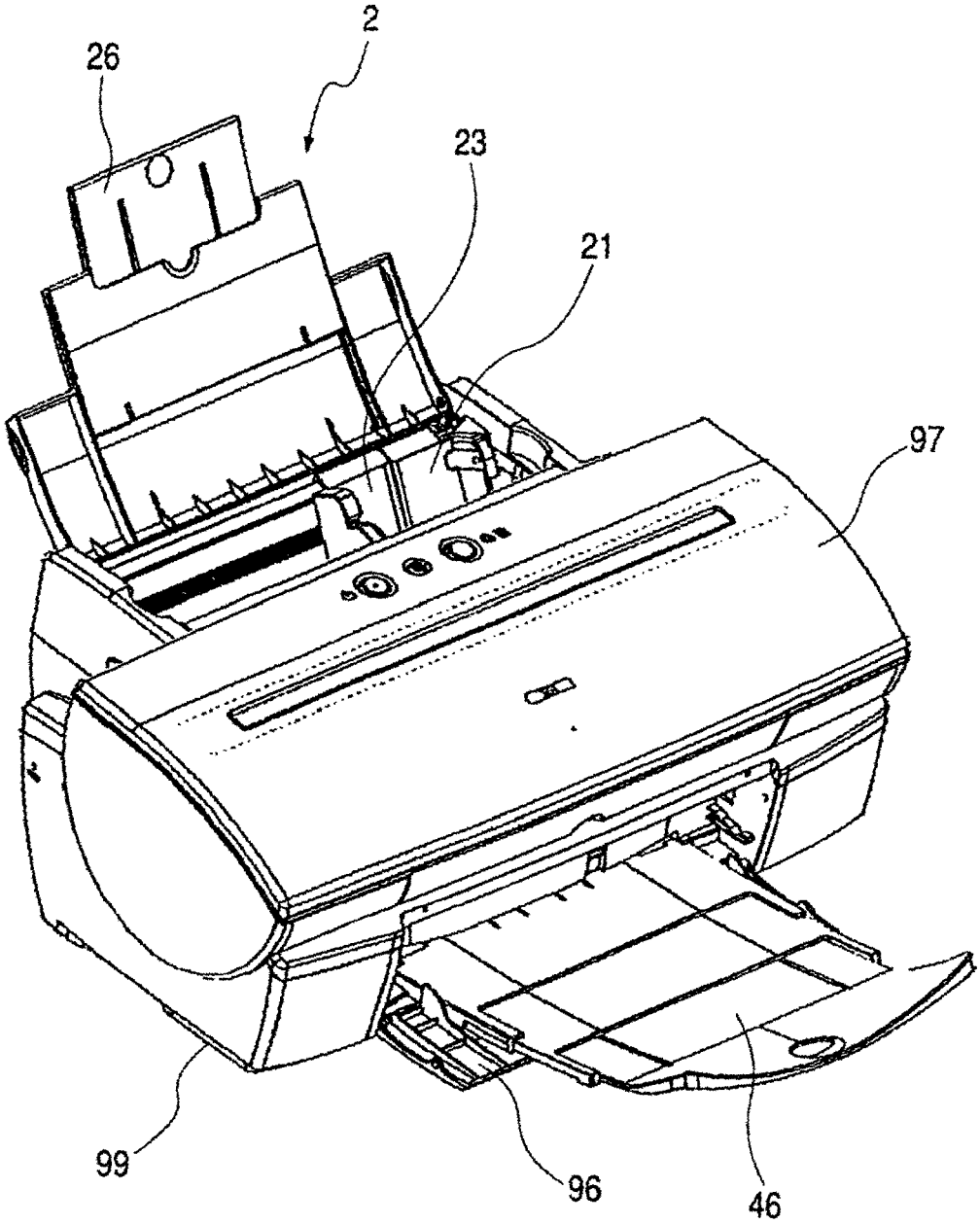
FIG. 2 is a perspective view showing a state in which in the recording apparatus of FIG. 1, a sheet feeding tray and a sheet discharging tray are opened.
Figure 3:
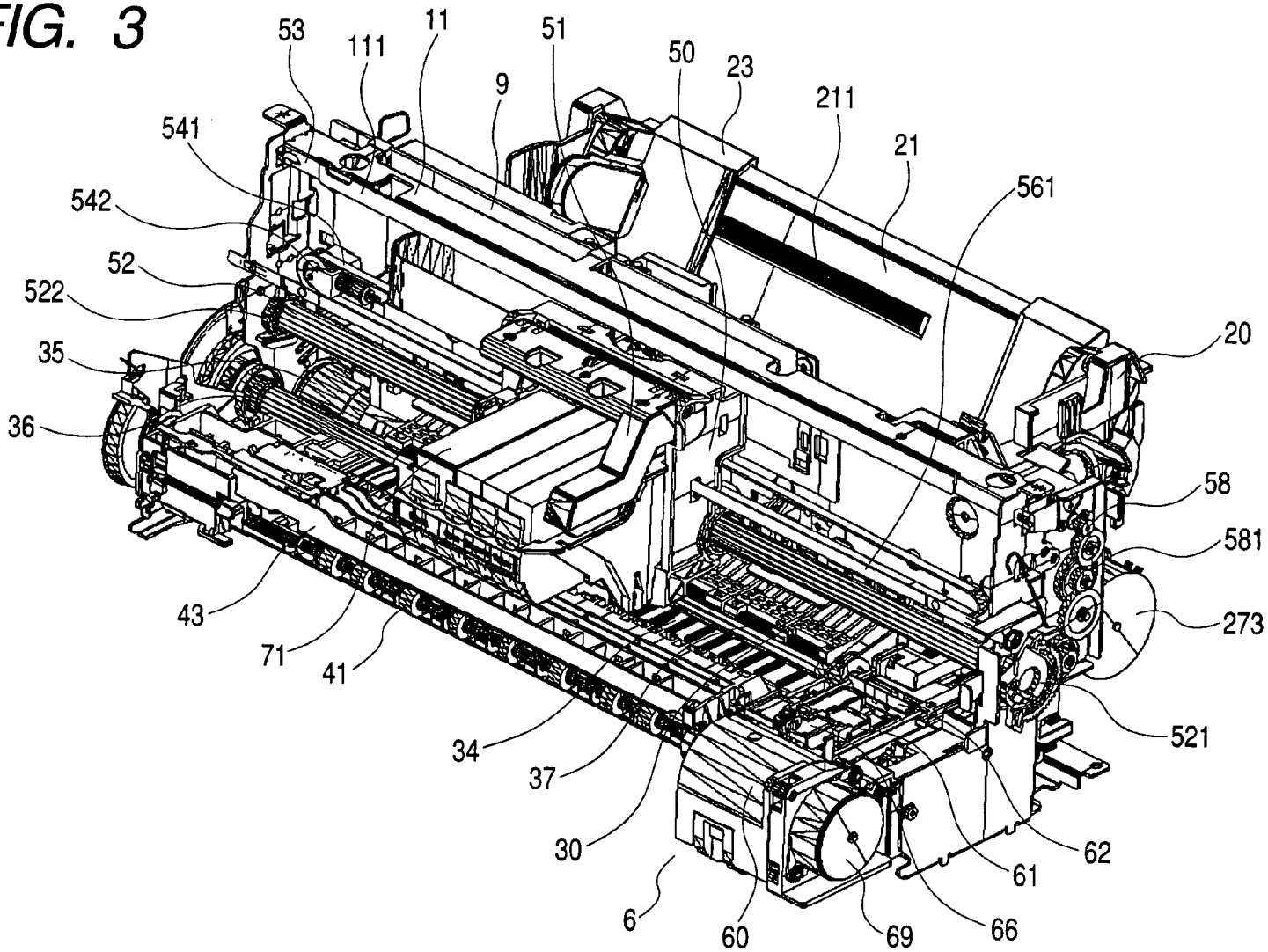
FIG. 3 is a perspective view showing the internal mechanism of the recording apparatus of FIG. 1 as it is seen from its right front.
Figure 4:
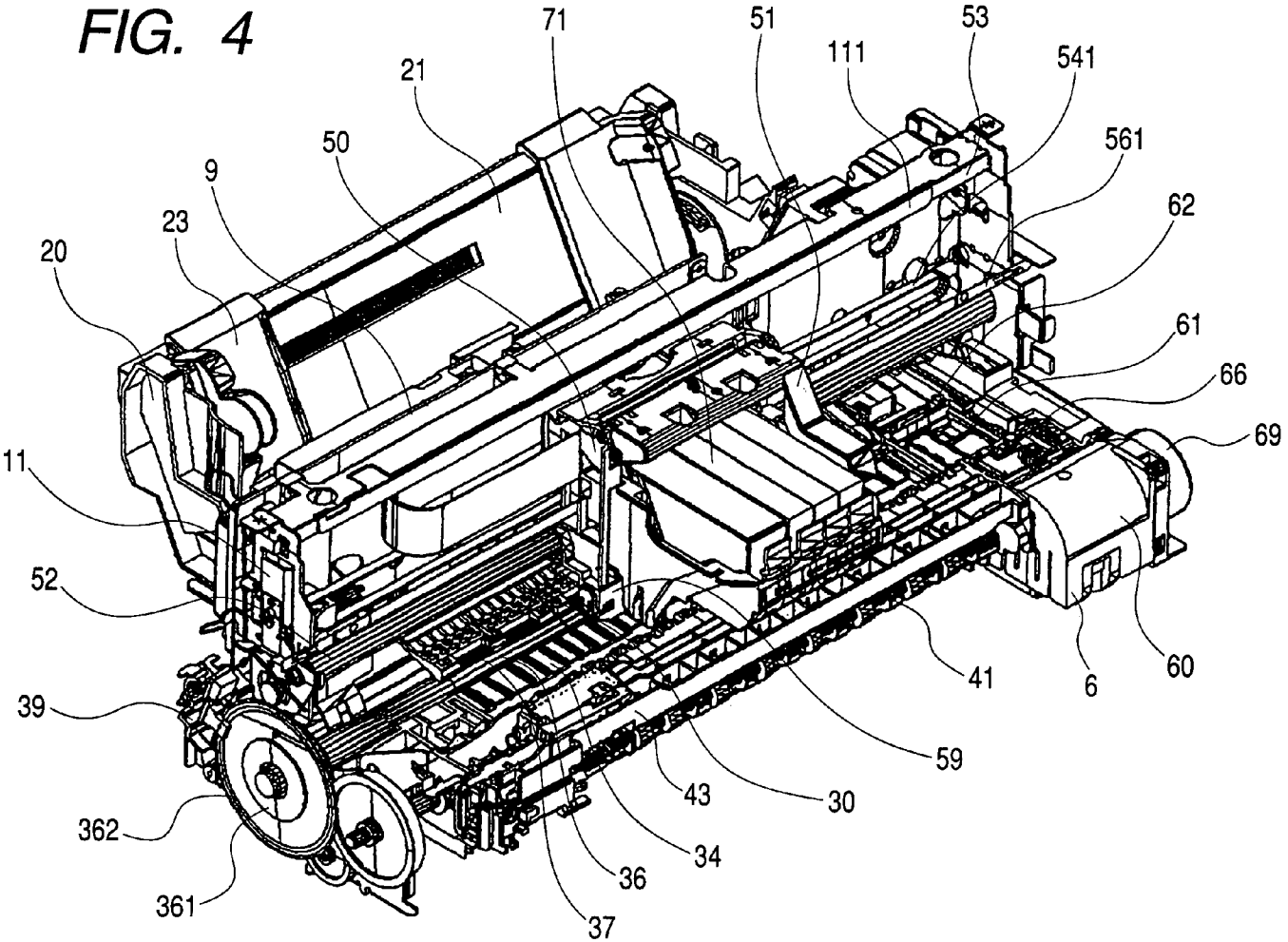
FIG. 4 is a perspective view showing the internal mechanism of the recording apparatus of FIG. 3 as it is seen from its left front.
Figure 5:
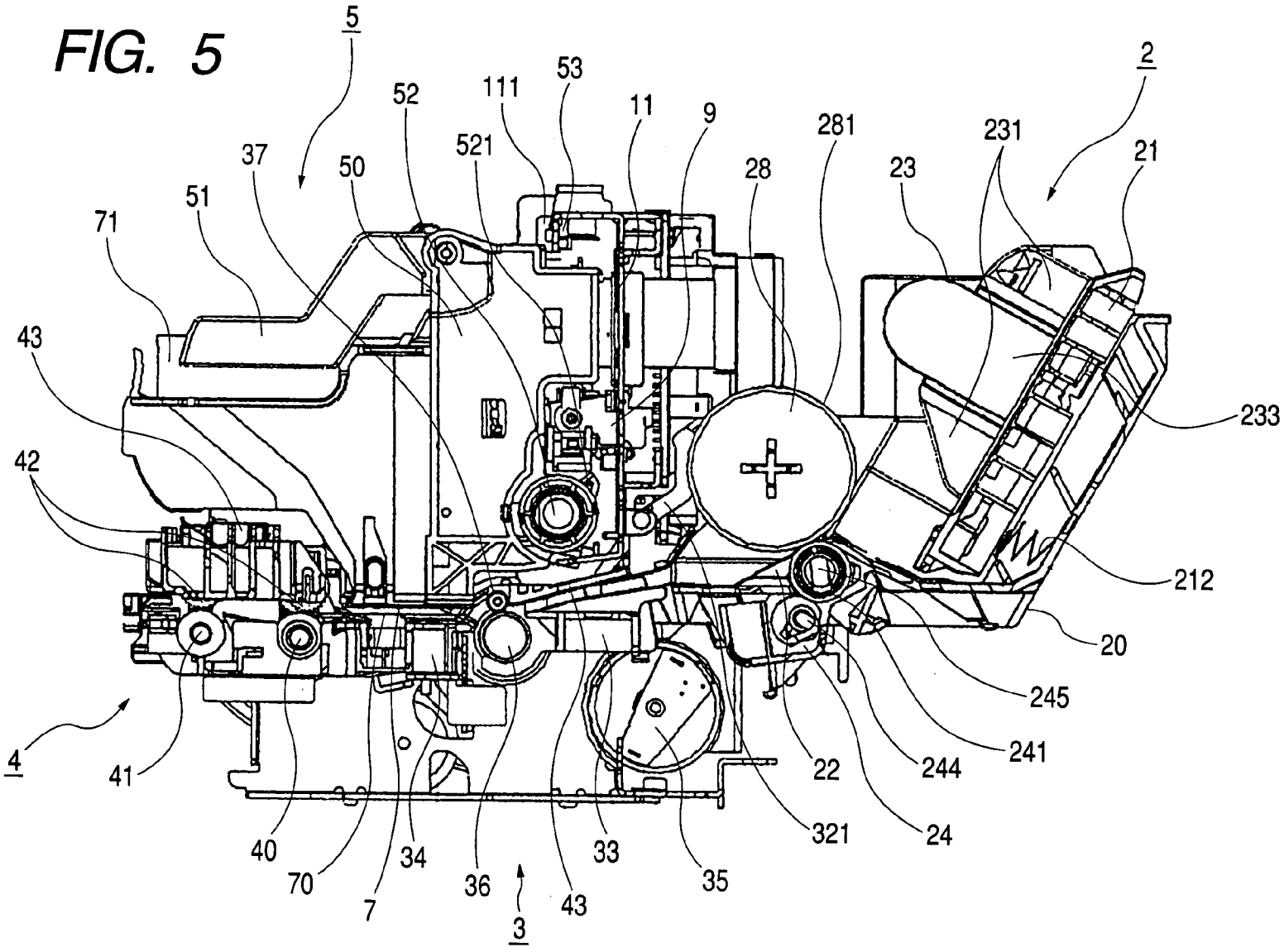
FIG. 5 is a vertical cross-sectional view of the recording apparatus of FIG. 3.
Figure 6A:
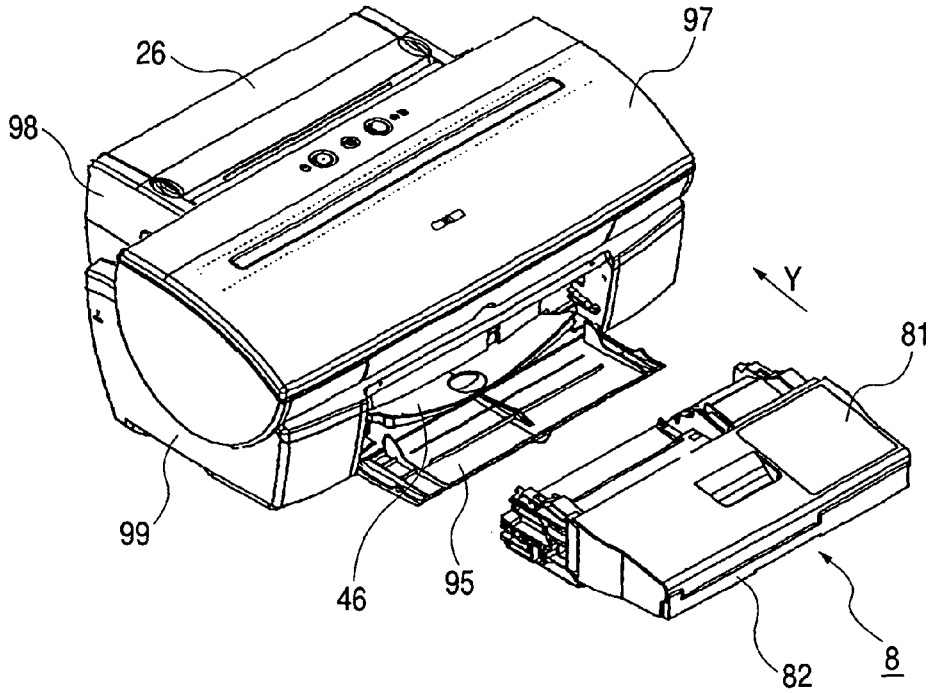
FIGS. 6A and 6B are perspective views showing the states before and after a CD conveying portion is installed in the recording apparatus of FIG. 1.
Figure 6B:
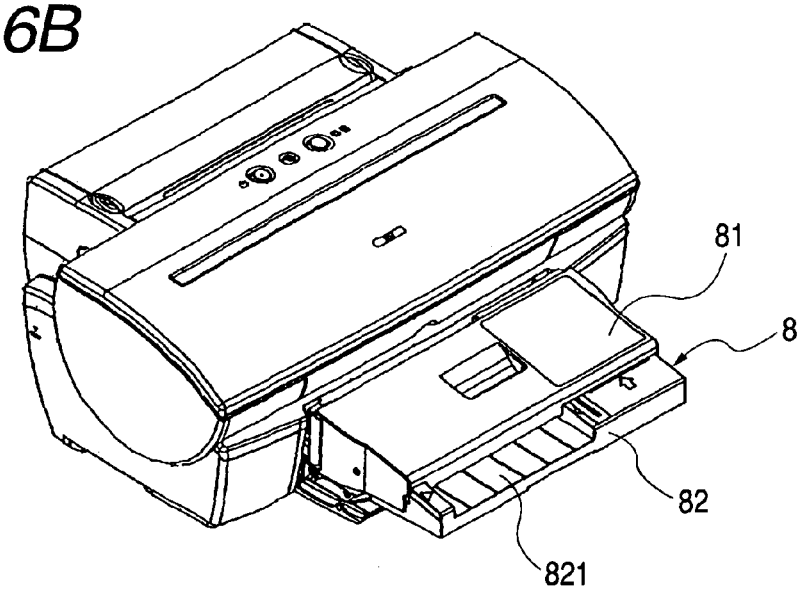
Figure 7:
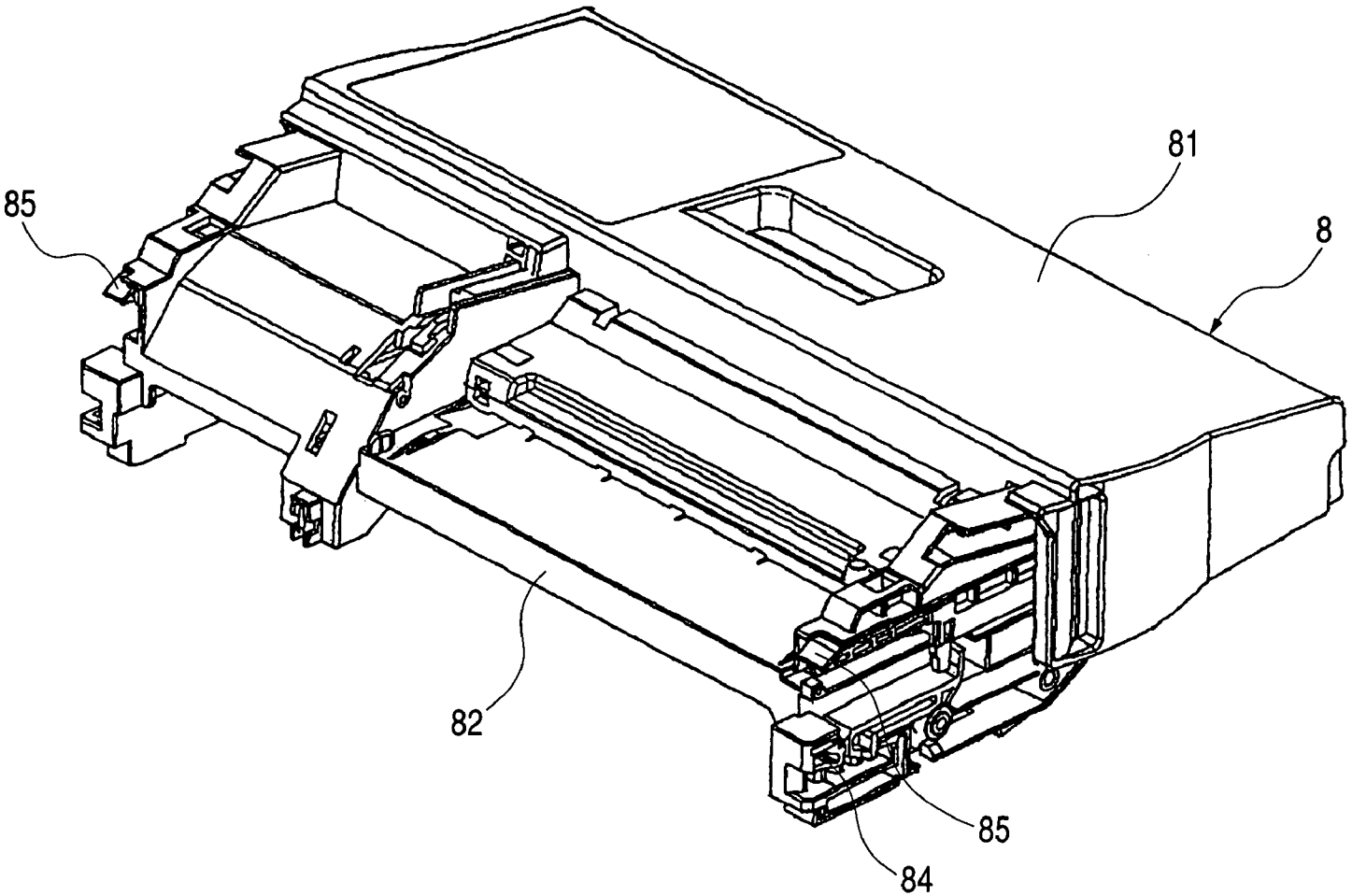
FIG. 7 is a perspective view showing the CD conveying portion mountable on the recording apparatus of FIG. 1.

FIG. 1 is a perspective view showing an embodiment of a recording apparatus to which the present invention is applied, and FIG. 2 is a perspective view showing a state in which in the recording apparatus of FIG. 1, a sheet feeding tray and a sheet discharging tray are opened. FIG. 3 is a perspective view showing the internal mechanism of the recording apparatus of FIG. 1 as it is seen from its right front, FIG. 4 is a perspective view showing the internal mechanism of the recording apparatus of FIG. 3 as it is seen from its left front, and FIG. 5 is a vertical cross-sectional view of the recording apparatus of FIG. 3. FIGS. 6A and 6B are perspective views showing the states before and after a CD conveying portion 8 is mounted on the recording apparatus of FIG. 1, and FIG. 7 is a perspective view showing the CD conveying portion 8 mountable on the recording apparatus of FIG. 1.

In FIGS. 1 to 5, the recording apparatus 1 according to the present embodiment is provided with a sheet feeding portion 2, a sheet conveying portion 3, a sheet discharging portion 4, a carriage portion 5, a recovery mechanism portion (cleaning portion) 6, recording means (a recording head) 7, a CD conveying portion 8 and an electric portion 9. These portions will hereinafter be divided into items and schematically described in succession. While in the present embodiment, the invention will be described with an ink jet recording apparatus taken as an example, the present invention is not restricted to the ink jet recording type, but can be applied to any one of recording apparatuses of a serial scan type in which a carriage carrying a recording head thereon is main-scanned in a direction intersecting with the conveying direction (sub-scanning direction) of a recording material. While for the sake of convenience of description, paper is taken as an example of the recording material, the present invention is not restricted thereto.

The sheet feeding portion 2 is comprised of a pressure plate 21 for stacking sheet materials P thereon, a sheet feeding roller 28 for feeding the sheet materials P, a separating roller 241 for separating the sheet materials P, a return lever 22 for returning the sheet materials P to a stacking position, etc., these members being mounted on a sheet feeding base 20. A sheet feeding tray 26 for holding the stacked sheet materials P is mounted on the sheet feeding base 20 or the exterior package of the recording apparatus. The sheet feeding tray 26, as shown in FIG. 2, is of a multistage type and is drawn out during use.

The sheet feeding roller 28 forms a rod-shaped rotary member having an arcuate cross-sectional shape, and is provided with sheet feeding roller rubber 281 on the sheet reference side thereof. The feeding (feeding-out) of the sheet materials is effected by such a sheet feeding roller 28. The driving of the sheet feeding roller 28 is effected by a driving force transmitted from a sheet feeding motor 273 provided in the sheet feeding portion 2 through a drive transmitting gear (not shown) and a planetary gear (not shown). A movable side guide 23 is movably provided on the pressure plate 21 and regulates the stacked position of the sheet materials P. The pressure plate 21 is pivotally movable about a rotary shaft coupled to the sheet feeding base 20, and is biased toward the sheet feeding roller 28 by a pressure plate spring 212. A separating sheet 213 formed of a material having a great coefficient of friction such as artificial leather is provided on that region of the pressure plate 21 which is opposed to the sheet feeding roller 28, in order to prevent the double feeding of the uppermost several of the plurality of stacked sheet materials P. The pressure plate 21 is designed to be capable of being brought into contact with and spaced apart from the sheet feeding roller 28 by a pressure plate cam (not shown).

Further, a separating roller holder 24 having mounted thereon the separating roller 241 for separating the sheet materials P one by one is mounted on the sheet feeding base 20 in a state in which it is pivotally movable about a rotary shaft provided on the sheet feeding base 20 and is biased toward the sheet feeding roller 28 by a separating roller spring (not shown). A separating roller clutch (clutch spring) 243 is mounted on the separating roller 241, and design is made such that when a predetermined or greater load is applied to the separating roller 241, a portion thereof on which the separating roller 241 is mounted can be rotated. The separating roller 241 is designed to be capable of being brought into contact with and spaced apart from the sheet feeding roller 28 by a separating roller release shaft 244 and a control cam (not shown). The positions of the pressure plate 21, the return lever 22 and the separating roller 241 are detected by an ASF sensor 29.

Also, the return lever 22 for returning the sheet materials P to the stacking position is pivotally movably mounted on the sheet feeding base 20 and is biased in a releasing direction by a return lever spring (not shown). This return lever 22 is designed to be pivotally moved by a control cam (not shown) when it returns the sheet materials P to the stacking position.

Description will hereinafter be made of a state in which sheet feeding is effected by the use of the above-described construction.

In an ordinary standby state, the pressure plate 21 is released by the pressure plate cam (not shown), the separating roller 241 is released by a control cam 25 and further, the return lever 22 returns the sheet materials P to the stacking position, and also is provided at such a stacking position as closes a stacking port so as to prevent the sheet materials P from coming into the inner part during stacking.

When sheet feeding is stacked from this state, the separating roller 241 first comes into contact with the sheet feeding roller 28 by motor drive. The return lever 22 is then released, and the pressure plate 21 comes into contact with the sheet feeding roller 28. In this state, the feeding of the sheet materials P is started. The sheet materials P are limited by a pre-stage separating portion (not shown) provided on the sheet feeding base 20, and only a predetermined number of sheet materials P are fed to a nip portion formed by the sheet feeding roller 28 and the separating roller 241. The thus fed sheet materials P are separated in this nip portion, and only the uppermost sheet material P is conveyed (fed).

When the sheet material P arrives at a pair of conveying rollers comprising a conveying roller 36 and pinch rollers 37 which will be described later, the pressure plate 21 and the separating roller 28 are released by the pressure plate cam (not shown) and the control cam (not shown), respectively. Also, the return lever 22 is returned to the stacking position by the control cam (not shown). At this time, the sheet material P having arrived at the nip portion between the sheet feeding roller 28 and the separating roller 241 can be returned to the stacking position.

(B) Sheet Conveying Portion

The sheet conveying portion 3 is mounted on a chassis 11 comprising a bent-up metal plate. The sheet conveying portion 3 has a conveying roller 36 for conveying the sheet material P, and a PE sensor (not shown). The conveying roller 36 is of a construction in which the surface of a metal shaft is coated with fine particles of ceramics, and it is mounted on the chassis 11 by the metallic portions of two shafts being received by bearings (not shown). In order to apply a load during rotation to the conveying roller 36 to thereby effect stable conveyance, a conveying roller tension spring (not shown) is provided between the bearings (not shown) and the conveying roller 36 so as to bias the conveying roller 36 to thereby apply a predetermined load.

A plurality of pinch rollers 37 driven to rotate are provided in contact with the conveying roller 36. The pinch rollers 37 are held by a pinch roller holder 30, and are brought into pressure contact with the conveying roller 36 by being biased by a pinch roller spring (not shown), and give birth to a conveying force for the sheet material P. The pinch roller holder 30 has its rotary shaft mounted on the bearing of the chassis 11, and is pivotally moved about the rotary shaft. Further, at the entrance of the sheet conveying portion 3 to which the sheet material P is conveyed, there are disposed a paper guide flapper 33 and a platen 34 for guiding the sheet material P. Also, the pinch roller holder 30 is provided with a PE sensor lever 321 for transmitting the detection of the leading edge and trailing edge of the sheet material P to a PE sensor 32. The platen 34 is mounted and positioned on the chassis 11. The paper guide flapper 33 is rotatable about a bearing portion (not shown) fitted to the conveying roller 36 and sliding, and abuts against the chassis 11 and is positioned thereby.

Also, a paper presser 341 for covering the end portion of the sheet material P is provided on the paper reference side of the platen 34. Thereby, even in the case of a sheet material P having its end portion deformed or a curled sheet material P, design is made such that it never happens that the end portion of the sheet material P floats up and interferes with a carriage 50 or the recording head 7. Further, the recording head 7 for forming an image on the basis of image information is provided downstream of the conveying roller 36 with respect to the conveying direction of the sheet material.

In the above-described construction, the sheet material P fed to the sheet conveying portion 3 is guided by the pinch roller holder 30 and the paper guide flapper 33 and is conveyed to a pair of rollers comprising the conveying roller 36 and the pinch rollers 37. At this time, the leading edge of the conveyed sheet material P is detected by the PE sensor lever 321 to thereby find the recording position (the printing position or the image forming position) of the sheet material P. Also, the sheet material P is conveyed on the platen 34 by the pair of rollers comprising the conveying roller 36 and the pinch rollers 37 being rotated by a conveying motor 35. A rib providing a conveyance reference surface is formed on the platen 34. This rib controls the gap between the sheet material P and the recording head 7, and also cooperates with a sheet discharging portion which will be described later to control the cockling of the sheet material P to thereby prevent the cockling from the becoming great.

The driving of the conveying roller 36 is effected by the rotating force of the conveying motor 35 comprising a DC motor being transmitted to a pulley 361 provided on the shaft of the conveying roller 36 by a timing belt 541.

Also, on the shaft of the conveying roller 36, there is provided a code wheel 362 for detecting the amount of conveyance by the conveying roller 36. This code wheel 362 is formed with markings at a pitch of 1501 pi–300 dpi. An encoder sensor 39 for reading the aforementioned markings is mounted on that region of the chassis 11 which is adjacent to the code wheel 362.

An ink jet recording head is used as the recording means (recording head) 7. Discrete ink tanks for respective ink colors are adapted to be interchangeably mounted on this recording head 7. Also, this recording head 7 can give heat to ink on the basis of recording data by a heater (heat generating element) or the like. Design is made such that the ink is film-boiled by this heat, and the ink is discharged from the discharge ports of the recording head 7 by a pressure change caused by the growth or contraction of a bubble by this film boiling, and an image is formed on the sheet material P by discharged ink drops.

(C) Carriage Portion

The carriage portion 5 has the carriage 50 on which the recording head 7 is mounted. This carriage 50 is guided and supported for reciprocal movement in a main scanning direction by a guide shaft 52 and a guide rail 111 installed in a direction intersecting with the conveying direction of the sheet material P. The guide rail 111 also has the function of holding the rear end of the carriage 50 to thereby maintain the gap (sheet interval) between the recording head 7 and the sheet material P at a proper value. The guide shaft 52 is mounted on the chassis 11, and the guide rail 111 is formed integrally with the chassis 11. A thin sliding sheet 53 of SUS or the like is extended on the sliding side of the guide rail 111 relative to the carriage 50, whereby a reduction in sliding sound is achieved.

Also, the carriage 50 is driven by a carriage motor (not shown) mounted on the chassis 11 through a timing belt 541. This timing belt 541 is extended and supported by an idle pulley 542. The timing belt 541 and the carriage 50 are coupled together through a damper (not shown) formed of rubber or the like, and the variation of the aforementioned carriage motor, etc. is attenuated to thereby reduce the unevenness of an image. In order to detect the position of the carriage 50, a code strip 561 marked with bars at a pitch of 1501 pi to 300 dpi is provided in parallelism to the timing belt 541. Further, an encoder sensor (not shown) which is a photosensor for optically reading the code strip 561 is provided on a carriage board (not shown) carried on the carriage 50. A contact (not shown) for effecting electrical connection to the recording head 7 is also provided on this carriage board (not shown). Also, on the carriage 50, there is provided a flexible substrate for transmitting a head signal from the electric portion (electric substrate 9) to the recording head 7.

In order to fix the recording head 7 as the recording means to the carriage 50, on the carriage 50, there are provided a dashing portion (not shown) for positioning and pressing means (head pressing means), not shown, for pressing and fixing the recording head 7. This pressing means is carried on a head set lever 51, and is designed such that when the head set lever 51 is pivotally moved about a rotary fulcrum to thereby set the recording head 7, a pressing force acts on the recording head 7.

Also, on the opposite ends of the guide shaft 52, there are provided an eccentric cam R (right eccentric cam) 521 and an eccentric cam L (left eccentric cam) 522, and by the driving of a carriage lifting motor 58, the drive is transmitted to the eccentric cam R 521 through a gear train 581, whereby the guide shaft 52 can be moved up and down. In conformity with the upward and downward movement of this guide shaft 52, the carriage 50 is likewise moved up and down and therefore, an optimum gap can be formed even for a sheet material P having a different thickness.

Further, on the carriage 50, there is mounted a tray position detecting sensor 59 comprising a reflection type sensor for detecting a mark (the reference numeral 834 in FIG. 13) for detecting the position of a CD printing tray (the reference numeral 13 in FIG. 13) to record (print) on the display portion of a compact and thick recording material such as CD-R. This tray position detecting sensor 59 cam emit light from a light emitting element, and receive the reflected light thereof to thereby detect the position of the aforementioned tray.

When in the above-described construction, an image is to be formed on the sheet material P, the sheet material P is conveyed to the position of a line to be recorded (the position in the conveying direction of the sheet material P), by the pair of rollers (the conveying roller 36 and the pinch rollers 37), and also the carriage 50 is moved to a recording (image forming) position (a position in a direction intersecting with the conveying direction of the sheet material P) by the carriage motor (not shown) to thereby oppose the recording head 7 to the recording position (image forming position). Thereafter, the recording head 7 discharges the ink toward the sheet material P by a signal from the electric portion (electric substrate) 9, whereby recording (image forming) is effected.

(D) Sheet Discharging Portion

The sheet discharging portion 4 is provided with two sheet discharging rollers 40, 41, a spur 42 abutting against these sheet discharging rollers 40, 41 and thereby capable of being driven to rotate, and a gear train for transmitting the drive of the conveying roller 36 to the sheet discharging rollers 40, 41.

The sheet discharging rollers 40, 41 are mounted on the platen 34. The sheet discharging roller 40 on the upstream side with respect to the conveying direction is comprised of a plurality of rubber portions (sheet discharging roller rubber) provided on a metal shaft. The first sheet discharging roller 40 is driven by the drive from the conveying roller 36 being transmitted through an idler gear. The second sheet discharging roller 41 is of a construction in which a plurality of elastic members of elastomer or the like are mounted on a shaft of resin. The sheet discharging roller 41 is driven by the drive being transmitted thereto from the sheet discharging roller 40 through an idler gear.

As the spur 42, use is made of one provided with a plurality of convex shapes around it by a thin plate of SUS and molded integrally with a resin portion. Such a spur 42 is mounted on a spur base 43. In the present embodiment, the mounting of the spur 42 onto the spur base 43 and the pressure contact thereof with the sheet discharging rollers 40, 41 are effected by a spur spring 44 provided with a coil spring in a bar-like shape. As the spur 42, there are one chiefly producing a conveying force for the sheet material P, and one chiefly preventing the floating-up of the sheet material P when recorded. The spur producing the conveying force is disposed at a location corresponding to the rubber portion of the sheet discharging rollers 40, 41 (the sheet discharging roller rubber portion or the elastic material portion). On the other hand, the spur for preventing the floating-up of the sheet material P is disposed at a location whereat the rubber portions of the sheet discharging rollers 40, 41 (the sheet discharging roller rubber) are absent (such as the location between the rubber portions).

A sheet edge support (not shown) is provided between the sheet discharging rollers 40 and 41. This sheet edge support (not shown) is for raising the opposite edges of the sheet material P, and holding the sheet material P by the ends of the sheet discharging rollers 40, 41 to thereby prevent damage to or the lowering of the quality of a recorded image caused by rubbing against the aforementioned image recording portion on the sheet material P. The aforementioned sheet edge support is designed to raise the opposite edges of the sheet material P and make the rigidity of the sheet material P by a resin member provided with a runner at the end thereof being biased by a sheet edge support spring (not shown) to thereby press the runner against the sheet material P with a predetermined pressure force, thereby being capable of holding the sheet material P.

By the above-described construction, the sheet material P on which recording (image forming) has been effected in the carriage portion 5 is nipped by the nip portion between the sheet discharging roller 41 and the spur 42, and is conveyed and discharged onto a sheet discharging tray 46. The sheet discharging tray 46 has divisional structure comprising a plurality of members, and is designed to be capable of being contained in the lower portion of the lower case 99 of the recording apparatus. This sheet discharging tray 46 is drawn out during use. In the shown sheet discharging tray 46, the height thereof is made greater toward the fore end thereof and the opposite side edges thereof are also made great in height, whereby an improvement in the stacking property of discharged sheet materials P and the prevention of the rubbing of the recording surfaces of the sheet materials P are achieved.

(E) Recovery Mechanism Portion (Cleaning Portion)

The recovery mechanism portion 6 is provided with a recovery motor 69 for exclusive use. Also, in the recovery mechanism portion 6, a one-way clutch (not shown) is provided so as to operate a pump 60 by the rotation of the recovery motor 69 in one direction, and perform the wiping operation of a blade 62 and the upward and downward movement of a cap 61 by the rotation (reverse rotation) of the recovery motor 69 in the other direction.

In the present embodiment, the pump 60 is designed to generate negative pressure by two tubes (not shown) being squeezed by a pump runner (not shown), and a value (not shown) or the like is provided in a suction path (a tube or the like) leading from the cap 61 to the pump 60. This suction recovery means is designed to generate negative pressure in the cap 61 by the pump 60 being made to act with the cap 61 brought into close contact with the discharge port surface of the recording head 7 (a capping state), and suck and discharge such foreign substances as viscosity-increased ink, bubbles and dust from the discharge port of the recording head 7 together with the ink by the negative pressure.

In the interior of the cap 61, there is provided a cap absorbing member (not shown) for decreasing the amount of residual ink (adhering ink) produced on the discharge port surface of the recording head 7 after suction. Also, in order to prevent the residual ink from being secured to the aforementioned cap absorbing member, design is made such that the pump 60 is operated with the cap 61 opened to thereby perform the idle sucking operation of sucking and removing the residual ink in the cap 61. The waste ink sucked by the pump 60 is absorbed and retained by a waste ink absorbing member (not shown) provided in the lower case 99 which will be described later.

Various recovery treating operations in the recovery mechanism portion 6, i.e., a series of recovering operations such as the wiping operation by the blade 62, the coming near and away operation (upward and downward movement) of the cap 61, and the opening and closing operation of the value (not shown) prevent between the cap 61 and the pump 60 are controlled by a main cam (not shown) comprising a plurality of cams provided coaxially with one another. Cams, arms (levers), etc. at regions corresponding to the respective recovery treating operations are operated by the aforementioned main cam, whereby predetermined recovery treating operations are executed.

The position (such as the pivotally moved position) of the aforementioned main cam can be detected by a position detecting sensor (not shown) such as a photointerrupter. Also, when the cap 61 is spaced apart (in the present embodiment, moved down) from the recording head 7, the blade 62 is moved in a direction orthogonal to the main scanning direction of the carriage 50 to thereby wipe (clean) the discharge port surface of the recording head 7. Also, in the present embodiment, there are provided a plurality of blades 62 comprising a blade for wiping the vicinity of the discharge ports of the recording head 7 and a blade for wiping the entire discharge port surface. When the blades have been moved to the innermost part, the blades 62 are made to about against a blade cleaner 66, whereby the ink (transferred ink) adhering to the blades 62 themselves or the like can be removed to thereby recover the cleaning performance of the blades 62.

(F) Outer Package Portion

Each functional portion and each mechanism portion (each unit) described above are incorporated into the chassis 11 of the recording apparatus 1 to thereby form the mechanism portions of the recording apparatus. An outer package portion is mounted in such a manner as to cover the surroundings of these mechanism portions. The outer package portion is comprised chiefly of the lower case 99, an upper case 98, an access cover 97, a connector cover 96 and a front cover 95.

A sheet discharging tray rail (not shown) is provided in the lower portion of the lower case 99, and a divided sheet discharging tray 46 is designed to be containable therein. Also, the front cover 95 is designed to close a sheet discharging port during non-use.

The access cover 97 is pivotally mounted on the upper case 98. An opening portion is formed in a portion of the upper surface of the upper case 98, and the ink tank 71 and the recording head 7 can be interchanged through this opening portion.

Also, in the upper case 98, there are provided a door switch lever (not shown) for detecting the opening and closing of the access cover 97, an LED guide 982 for transmitting and displaying the light of an LED, a key switch 983 for acting on the switch of the electric portion (circuit substrate), etc.

Further, a multistage type sheet feeding tray 26 is pivotally mounted on the upper case 98. Design is made such that if the sheet feeding tray 26 is contained when the sheet feeding portion is not used, the sheet feeding tray 26 functions as the cover of the sheet feeding portion. Also, the upper case 98 and the lower case 99 are mounted by a fitting claw having resiliency. The region between the upper case 98 and the lower case 99 in which a connector portion is provided is covered with a connector cover 96.

The construction when a compact disk (CD) conveying portion 8 is used in the recording apparatus to which the present invention is applied and the details of CD printing will now be described with reference to FIGS. 6A and 6B to 19.

Figure 8:
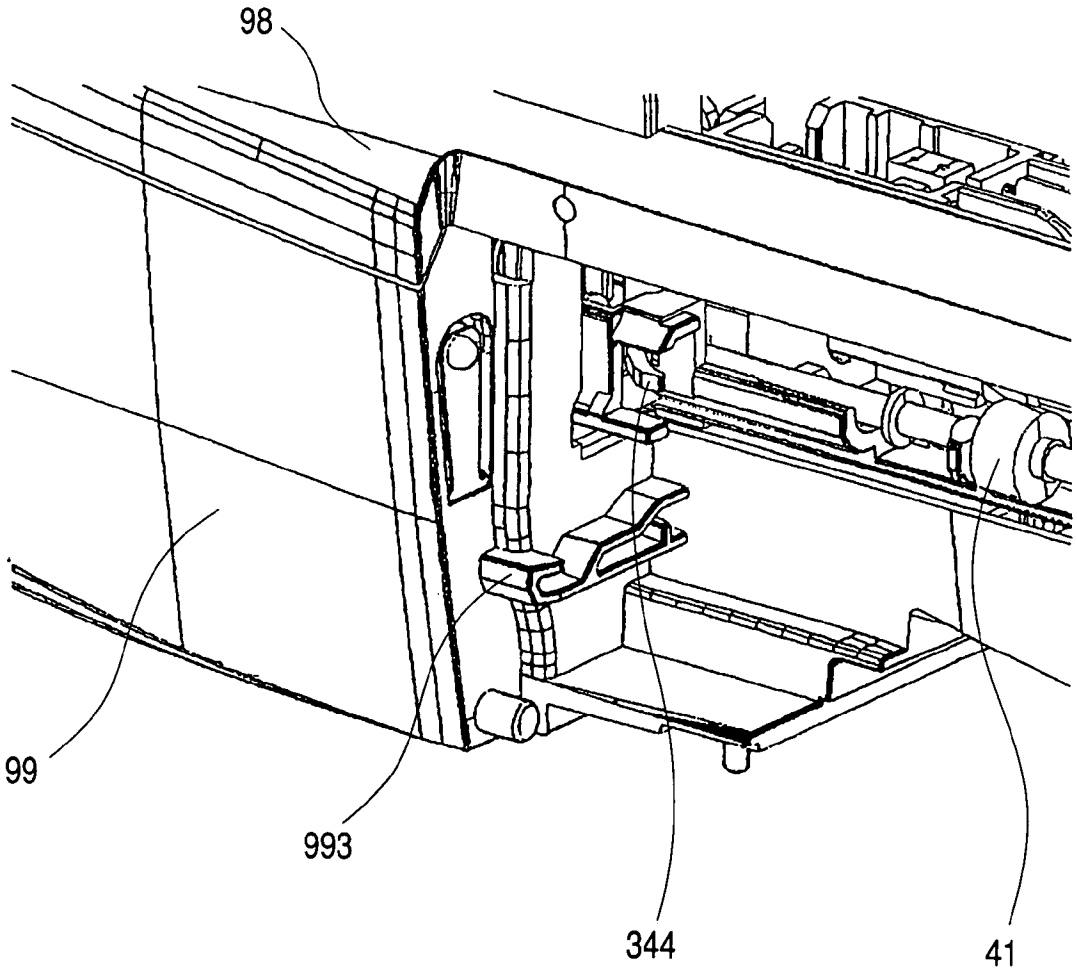
FIG. 8 is a fragmentary perspective view showing the CD conveying portion mounting portion and mounting detecting portion of the lower case of the recording apparatus to which the present invention is applied.
Figure 9:
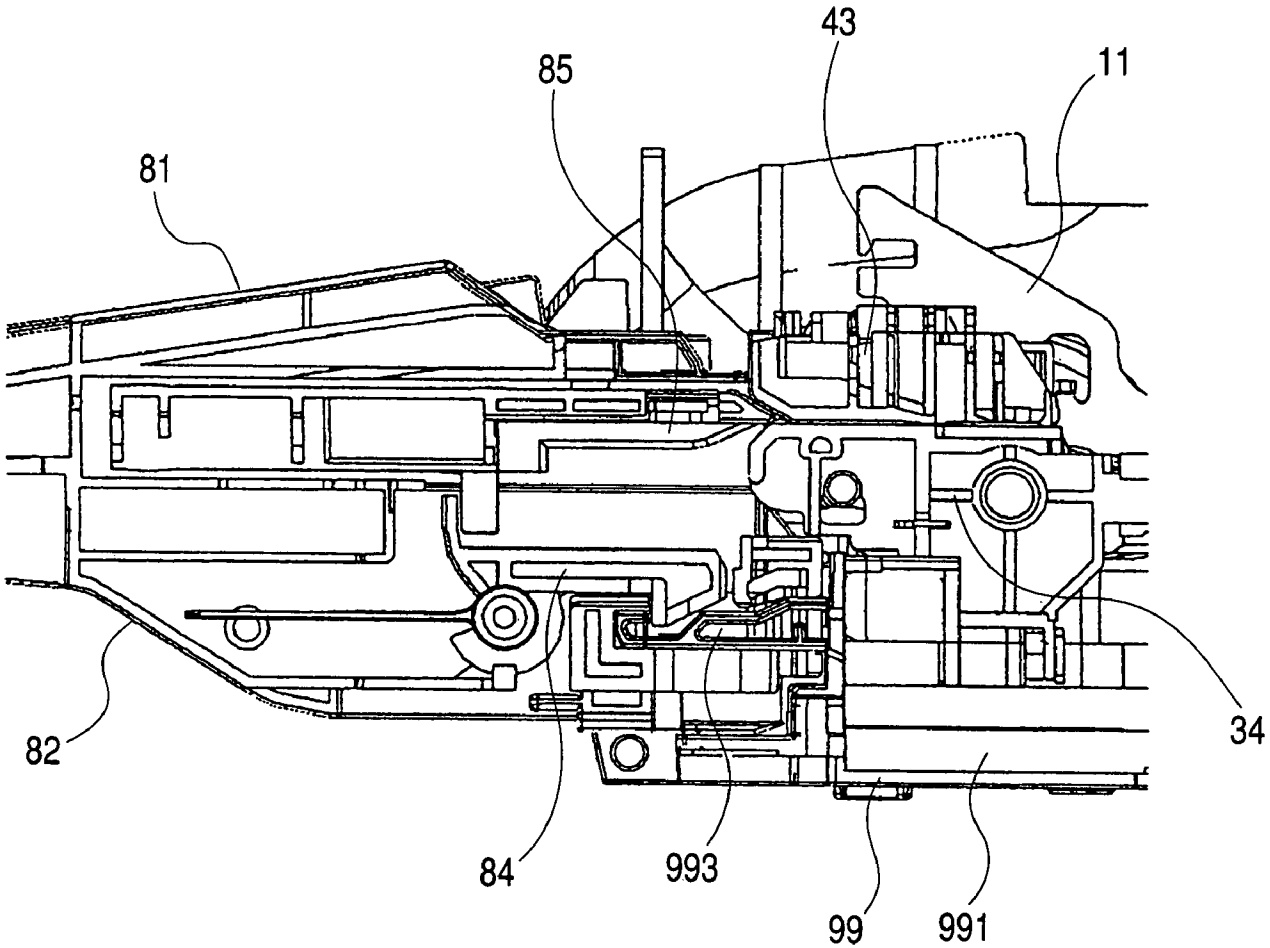
FIG. 9 is a fragmentary vertical cross-sectional view showing the mounted state of the lower case and the hook of the CD conveying portion of the recording apparatus to which the present invention is applied.
Figure 10A:
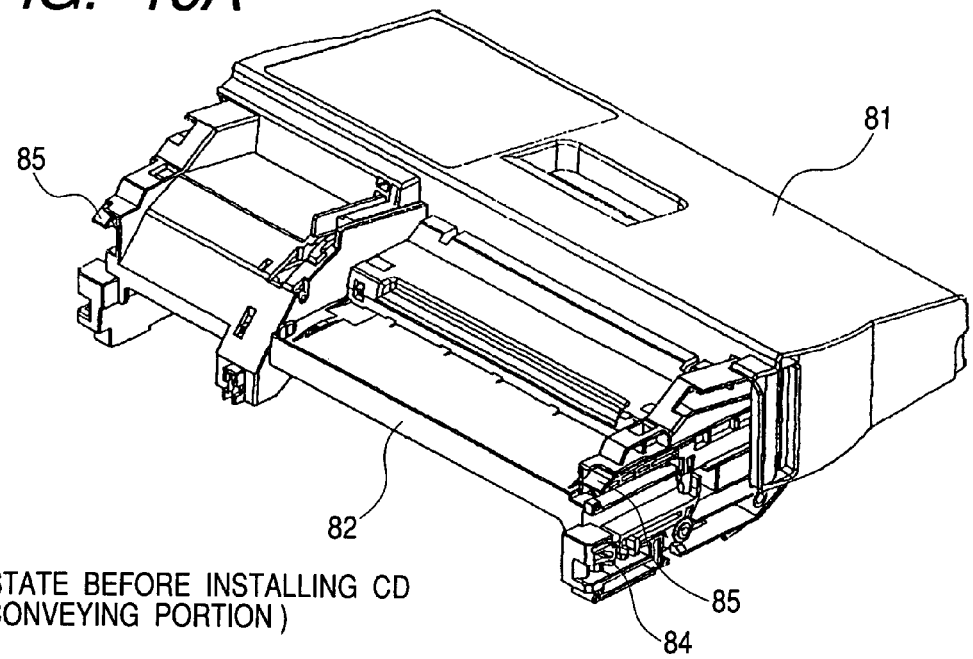
FIGS. 10A and 10B are perspective views showing the states when a slide cover is moved before and after the mounting of the CD conveying portion mountable on the recording apparatus to which the present invention is applied.
Figure 10B:
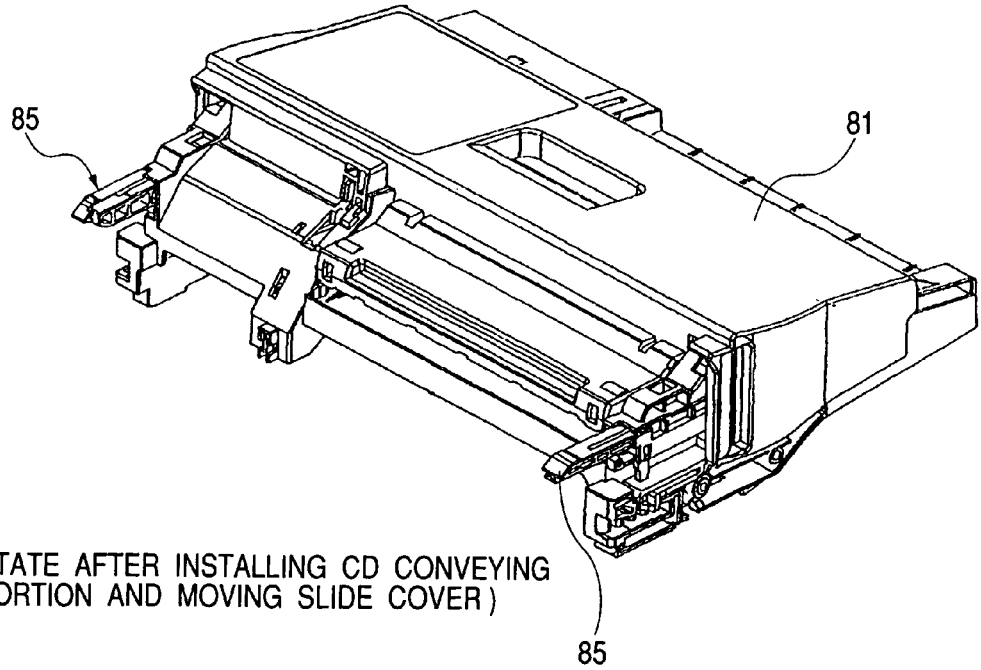
Figure 11:
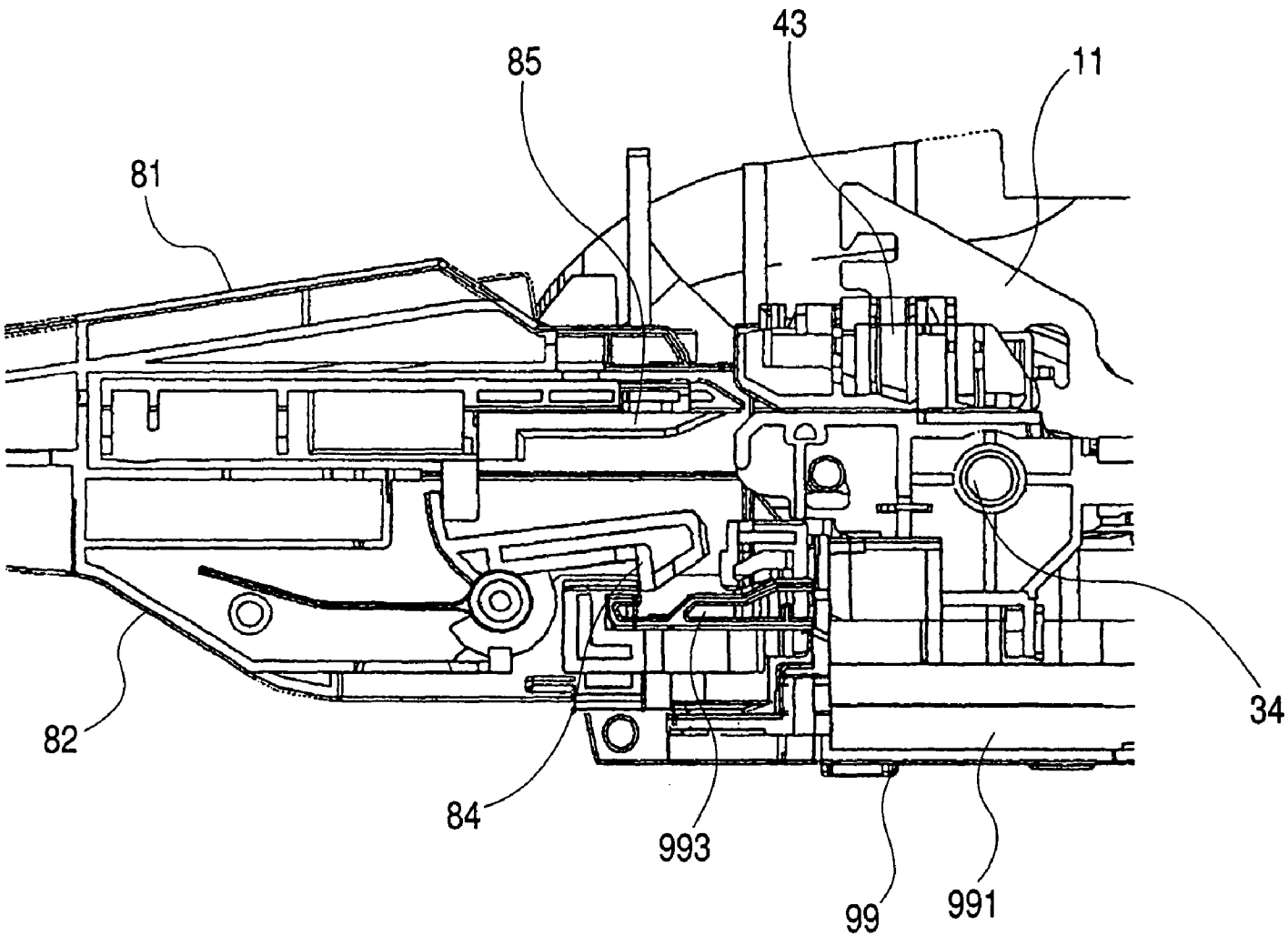
FIG. 11 is a fragmentary vertical cross-sectional view showing the state in which the hook of the CD conveying portion has been released from the lower case of the recording apparatus to which the present invention is applied.
Figure 12A:
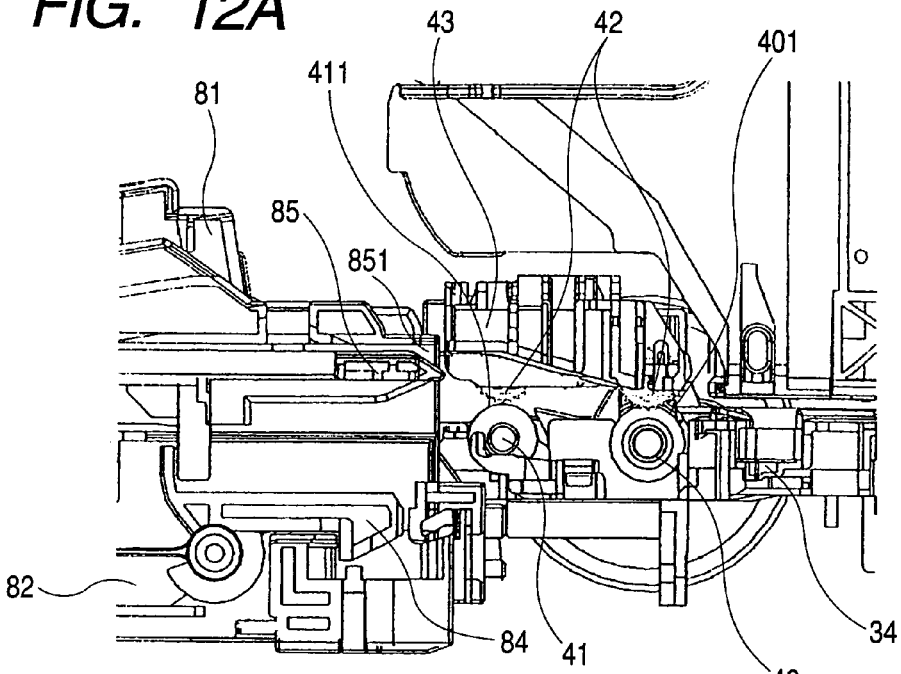
FIGS. 12A and 12B are fragmentary cross-sectional views showing the states of an arm before and after the movement of the slide cover of the CD conveying portion in the recording apparatus to which the present invention is applied.
Figure 12B:
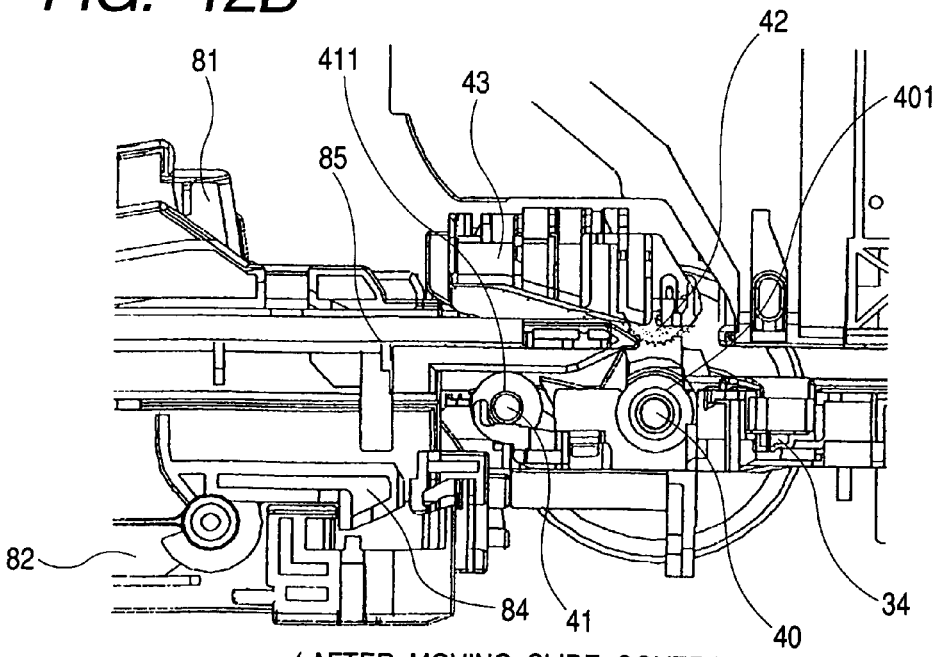

FIG. 6A is a perspective view showing the state before the CD conveying portion 8 is installed in the recording apparatus of FIG. 1, and FIG. 6B is a perspective view showing the state after the CD conveying portion 8 has been installed in the recording apparatus. FIG. 7 is a perspective view showing the CD conveying portion 8 mountable on the recording apparatus of FIG. 1, and FIG. 8 is a fragmentary perspective view showing the CD conveying portion mounting portion and the mounting detecting portion of the lower case 99. FIG. 9 is a fragmentary vertical cross-sectional view showing the mounted state of the lower case 99 and the hook 84 of the CD conveying portion 8, and FIGS. 10A and 10B are perspective views showing the state when a slide cover 81 is moved before and after the mounting of the CD conveying portion 8. FIG. 11 is a fragmentary vertical cross-sectional view showing the state when the hook 84 of the CD conveying portion 8 has been released from the lower case 99, and FIGS. 12A and 12B are fragmentary vertical cross-sectional views showing the state of an arm 85 before and after the movement of the slide cover 81 of the CD conveying portion 8.

Figure 13:
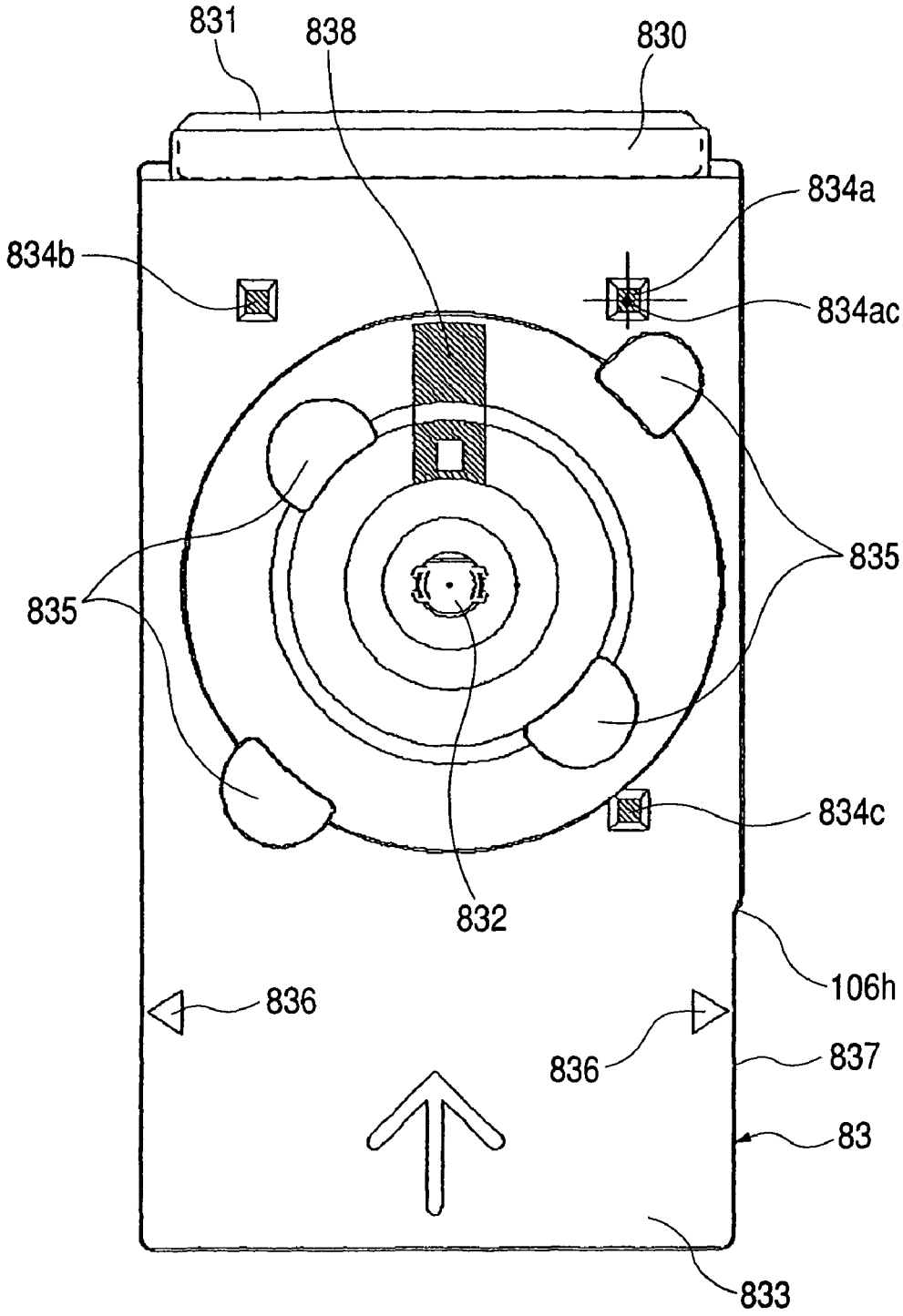
FIG. 13 is a plan view of the tray of the CD conveying portion of the recording apparatus to which the present invention is applied.
Figure 14:
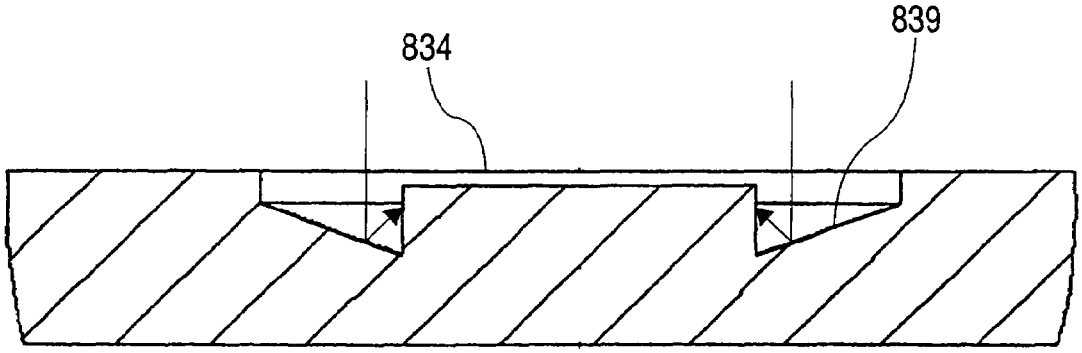
FIG. 14 is a typical cross-sectional view showing the shape of the concave portion of the position detecting portion of the tray of FIG. 13.
Figure 16:
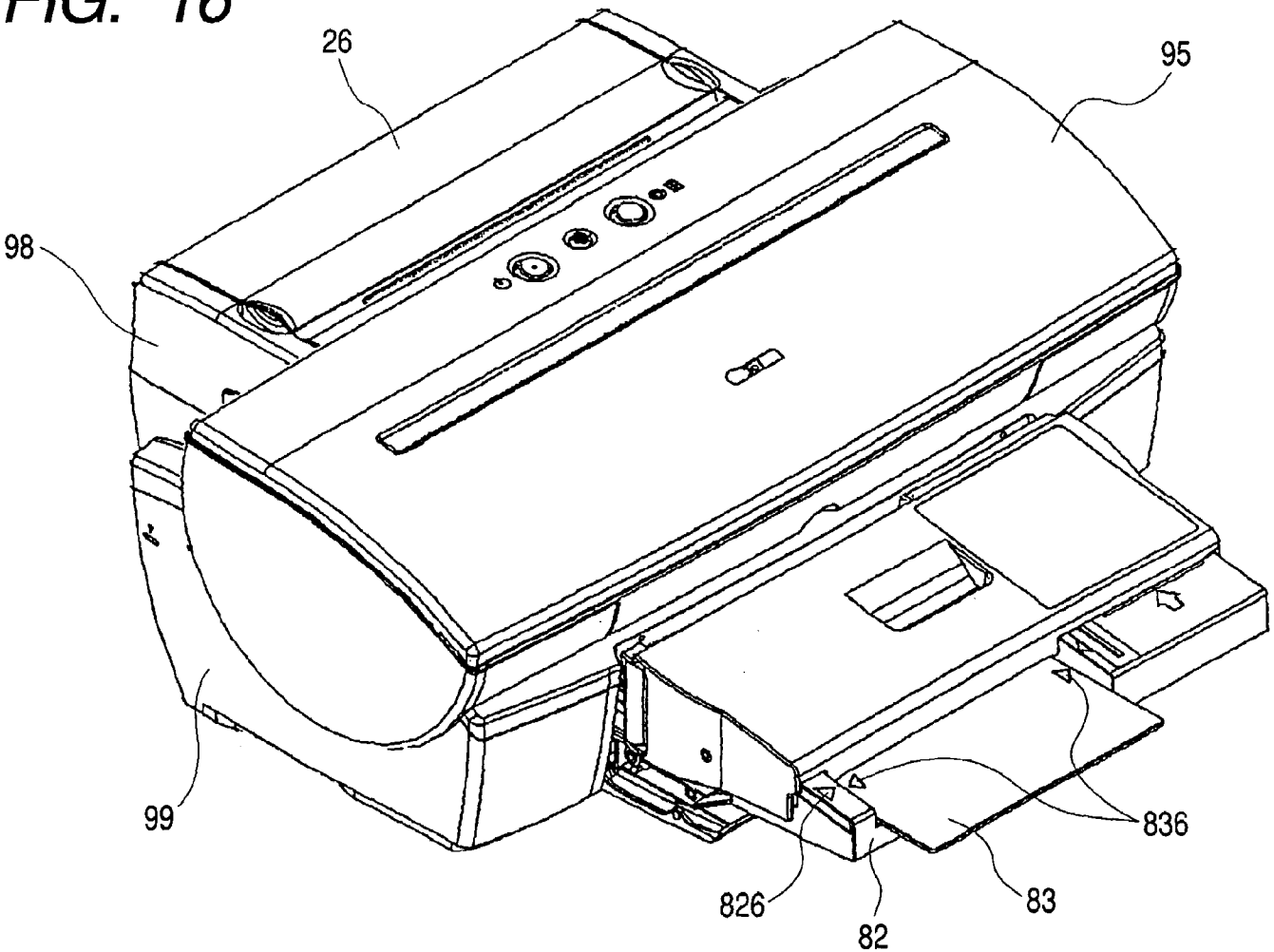
FIG. 16 is a perspective view showing a state in which the tray is inserted and set in the CD conveying portion mounted on the recording apparatus to which the present invention is applied.
Figure 17:
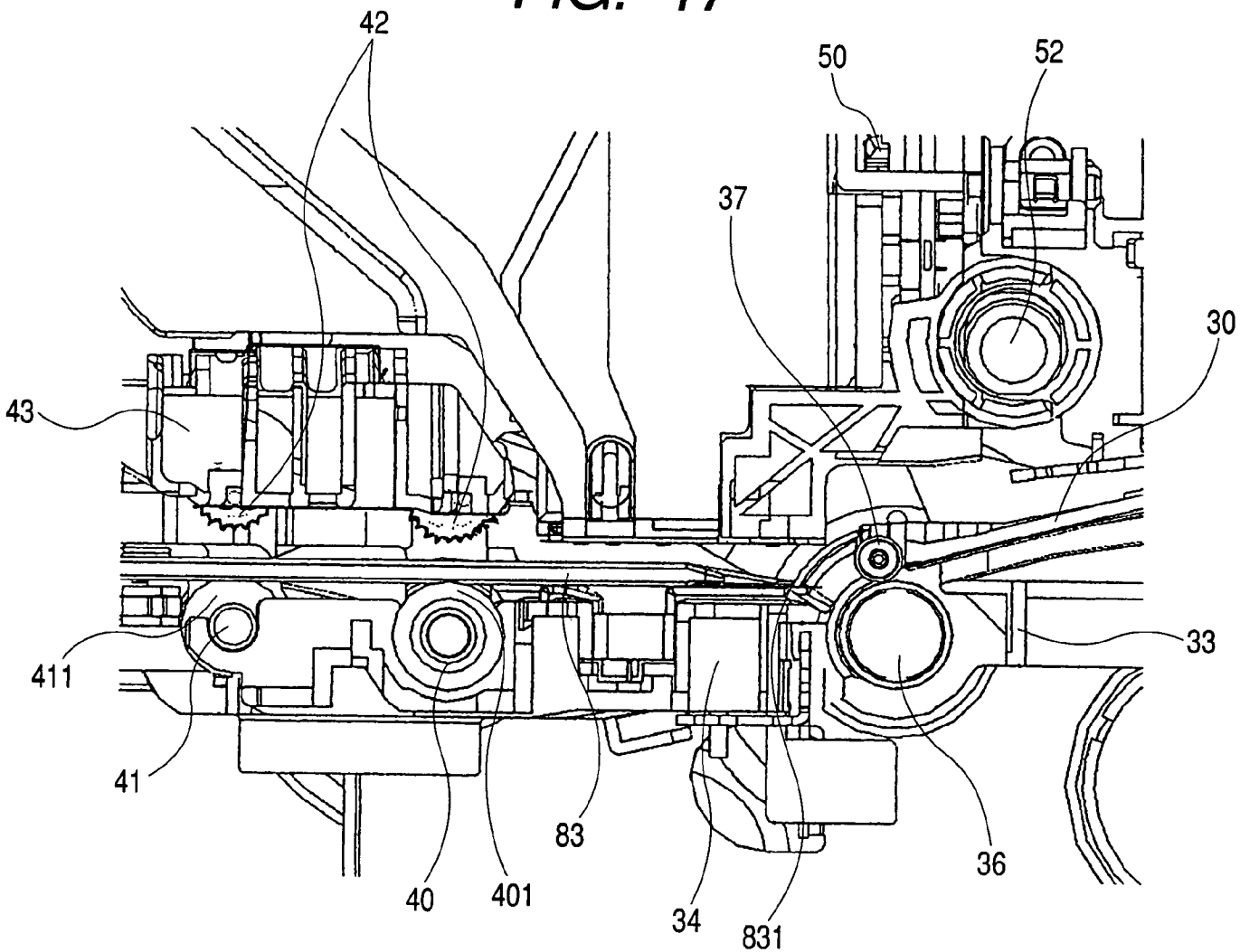
FIG. 17 is a fragmentary vertical cross-sectional view showing a state in which the tray is conveyed through the interior of the recording apparatus to which the present invention is applied.
Figure 18A:
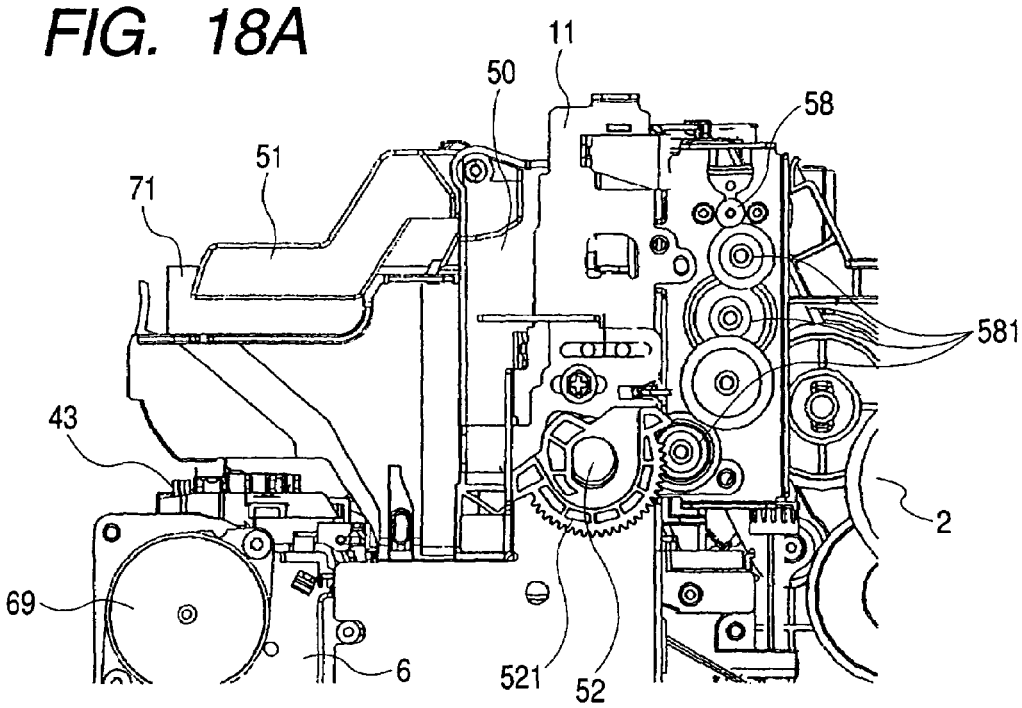
FIGS. 18A and 18B are fragmentary vertical cross-sectional views showing the states during the carriage downward movement and the carriage upward and movement of a shaft lifting mechanism for moving up and down the guide shaft of a carriage in the recording apparatus to which the present invention is applied.
Figure 18B:
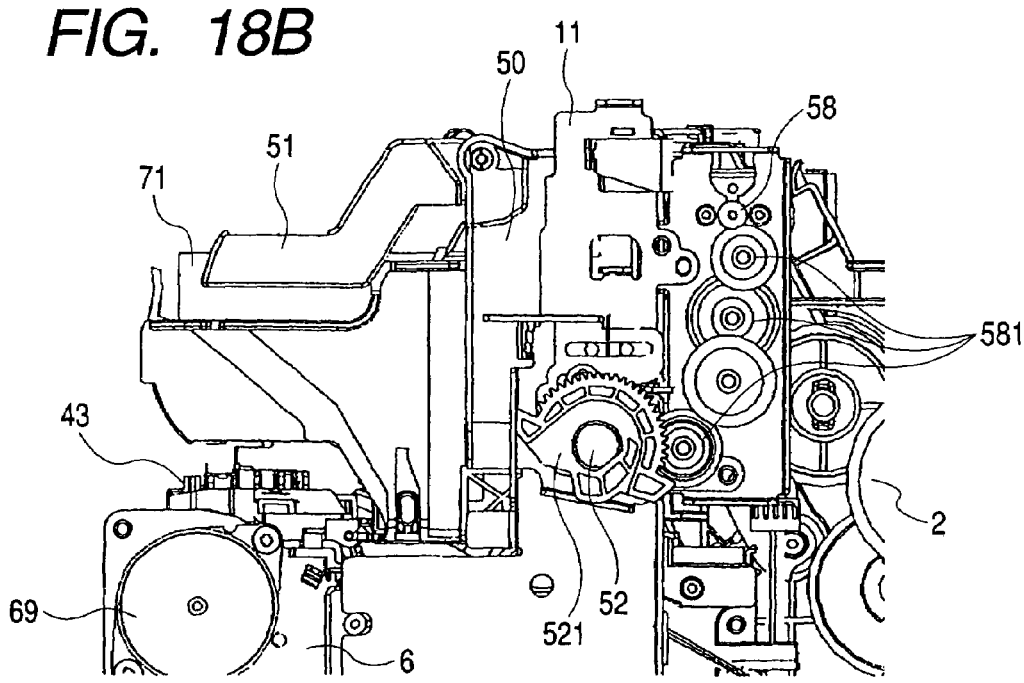
Figure 19:
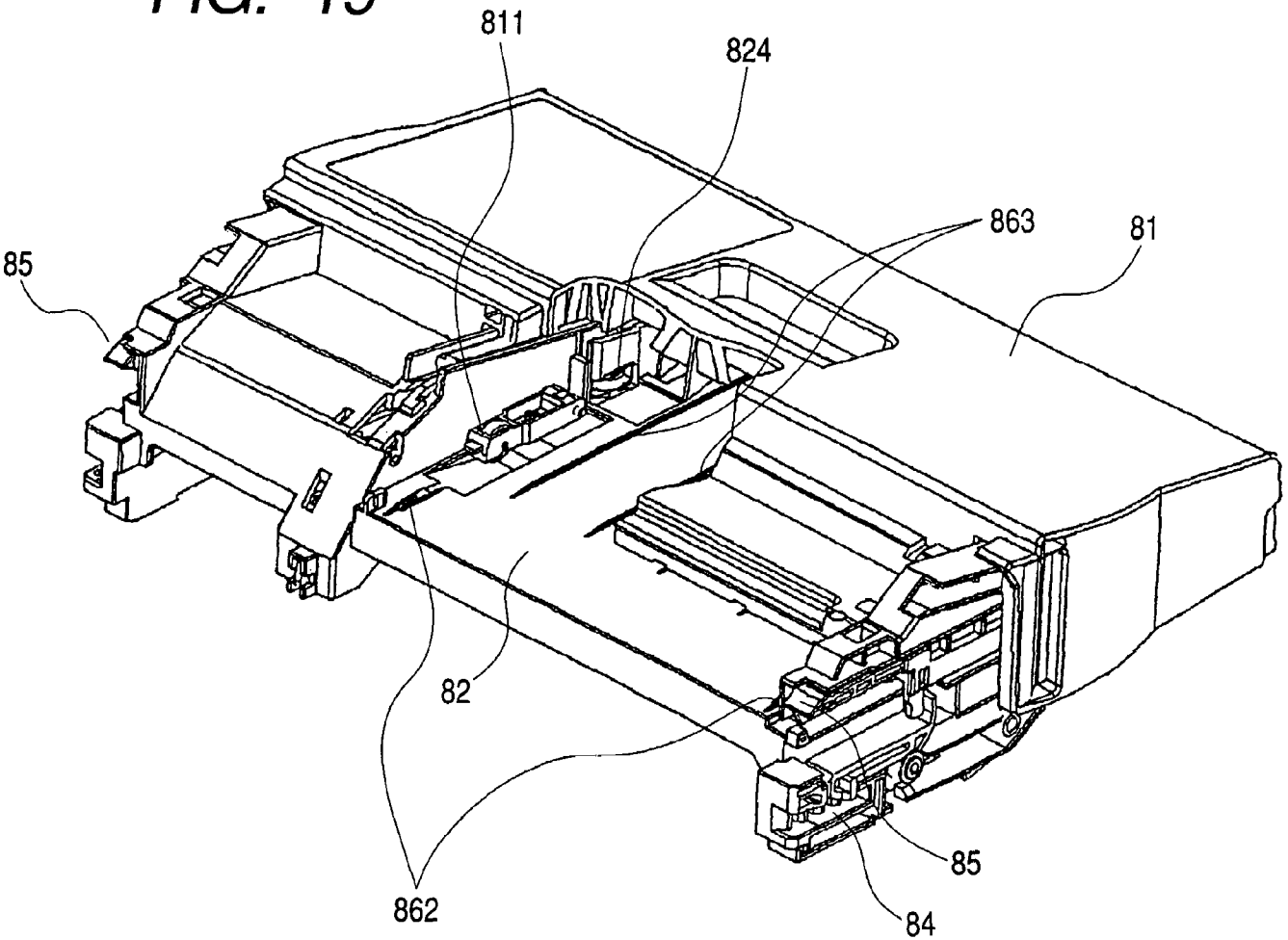
FIG. 19 is a partly broken-away perspective view of the CD conveying portion mounted on the recording apparatus to which the present invention is applied for showing the pressing runner and side pressure runner of the CD conveying portion.

Further, FIG. 13 is a plan view of the tray 83 of the CD conveying portion 8, FIG. 14 is a typical cross-sectional view showing the shape of the concave portion of the position detecting portion of the tray 83 shown in FIG. 13, and FIGS. 15A to 15F are typical plan views showing the various states of the relative position of the tray of FIG. 13 and a tray position detecting sensor 59. FIG. 16 is a perspective view showing a state in which the tray 83 is inserted and set in the CD conveying portion 8 installed in the recording apparatus, and FIG. 17 is a fragmentary vertical cross-sectional view showing a state in which the tray 83 is conveyed through the interior of the recording apparatus. FIGS. 18A and 18B are fragmentary vertical cross-sectional views showing the states during the carriage upward movement and the carriage downward movement of a shaft lifting mechanism for moving up and down the guide shaft 52 of the carriage 50, and FIG. 19 is a partly broken-away perspective view of the CD conveying portion 8 for showing the pressing runner 811 and side pressure runner 824 of the CD conveying portion 8.

When as shown in FIG. 6A, the CD conveying portion 8 is slidden straight in the direction of arrow Y, the CD conveying portion 8 is installed in the lower case 99 of the recording apparatus. At this time, the fitting portions (not shown) of the opposite ends of a tray guide 82 are inserted along CD conveying portion guide rails 993 provided on the opposite sides of the lower case 99 shown in FIGS. 8 and 9, whereby the positioning of the CD conveying portion 8 is effected. Pivotally movable hooks 84 are provided on the end portions of the right and left sides of the tray guide 82, and the hooks 84 are biased in one direction. The CD conveying portion 8, when slidden and inserted to a predetermined position, strikes against a certain region and is not inserted any further. The hooks 84 then act on the stoppers of the CD converting portion guide rails 993 to thereby lock the CD conveying portion 8 so as not to return in the direction in which it has been slidden.

A tray guide detecting sensor 344 for mechanically detecting a state in which the tray guide 82 (the CD conveying portion 8) has been installed at a predetermined location in the recording apparatus is provided on the platen 34. Design is made such that when the tray guide 82 is installed in the main body of the recording apparatus, a portion of the tray guide 82 pushes the tray guide detecting sensor 344, whereby it can be detected that the CD conveying portion 8 (the tray guide 82) has been installed.

Next, when as shown in FIGS. 10A, 10B, 12A and 12B, the slide cover 81 is moved toward the main body of the recording apparatus, the arm 85 protrudes toward the main body of the recording apparatus in operative association with the slide cover 81. A spur base 43 carrying the spur 42 thereon is mounted for sliding movement in a vertical direction relative to the platen 34, and is downwardly biased by a spring force of predetermined pressure. Accordingly, the arm 85 comes into between the spur base 43 and the platen 34, whereby the spur base 43 is raised upwardly by a predetermined amount. In this case, the arm 85 can smoothly come into between the platen 34 and the spur base 43 by an inclined portion 851 formed on the tip end of the arm 85. Thereby, a space for making the tray 83 on which a CD (such as a CD-R) as a storage medium pass therethrough can be formed between the platen 34 and the spur base 43.

Also, the arm 85 is adapted to be positioned in a state in which it has been inserted between the platen 34 and the spur base 43, and in a state in which it has been contained in the tray guide 82 before protruding (advancing), it is contained in a state in which it has backlash relative to the tray guide 82 (a movable state).

Also, in a state in which at first, the slide cover 81 is not moved toward the main body of the recording apparatus, the opening portion 821 of the CD conveying portion 8 is closed and therefore, the tray 83 cannot be inserted. When the slide cover 81 is then moved toward the main body of the recording apparatus, slide cover 81 is designed to move obliquely upwardly and therefore, an opening portion 821 for inserting the tray therethrough is formed between the slide cover 81 and the tray guide 82 (FIG. 6B). If this state is brought about, as shown in FIG. 16, the tray 83 loaded with the CD can be inserted through the opening portion 821 and set in a predetermined position.

The reason for adopting such a construction is for preventing the tray 83 and the spur 42 from interfering with each other to thereby damage a tray sheet 831 on the distal end of the tray 83 and the spur 42 when the tray 83 is inserted with the spur base 43 not moved up.

When as shown in FIG. 11, the slide cover 81 is drawn out of the main body of the recording apparatus with the tray guide 82 installed, the arm 85 comes off from the spur base 43 in operative association with the slide cover 81, and the spur base 43 and the spur 44 move down to their original predetermined positions. Design is made such that if at this time, the tray 83 remains mounted, the tray 83 will be caught in the opening portion 821 between the slide cover 81 and the tray guide 82, and the slide cover 81 cannot be drawn out any further. Thereby, the occurrence of the inconvenience that the spur 44 is lowered while a recording medium such as a CD-R remain left in the main body of the recording apparatus, thereby damaging the recording medium is prevented.

When the slide cover 81 is further drawn, the slide cover 81 acts on the hooks 84, as shown in FIG. 11, whereby the hooks 84 come off from the CD conveying portion guide rail 993 of the lower case 99, whereby the mounting of the CD conveying portion 8 onto the main body of the recording apparatus is released.

The tray 83 in the present embodiment is comprised of a resin plate having a plate thickness of the order of 2 mm–3 mm, and the resin plate, as shown in FIG. 13, is provided with an operating portion 833 for an operator to grasp when the tray is put in and out, position detecting marks 834 (in FIG. 13, at three locations 834*a*, 834*b* and 834*c*), a CD taking-out hole 835, a tray insertion aligning mark 836, a side pressure runner escape portion 837, a media presence or absence detecting mark 838 and a tray adapter kind detecting mark (not shown) provided to distriminate the kind of a tray adapter.

Also, on the digital end portion of the above-described tray 83, there is mounted a tray sheet 831 for ensuring the meshing of the tray 83 with the conveying roller 36 and the pinch rollers 37.

The position detecting marks 834 are provided at two locations (834*a* and 834*b*) on the distal end side of the CD mounting portion of the tray 83 and at a location (834*c*) on the opposite side. Each of the position detecting marks 834 has a member of high reflecting performance provided in a square of the order of 3 mm–10 mm. Herein, it is formed by the use of a hot stamp.

As shown in FIGS. 13 and 14, a concave portion 839 is provided around each position detecting mark 834, and design is made such that a reflecting material can be formed in a form along the shape of the position detecting mark 834 portion of a resin part. Also, as shown in FIG. 14, the bottom of the concave portion 839 of each position detecting mark has a high surface property and is formed with a predetermined angle and therefore, design is made such that even if the emitted light of a tray position detecting sensor 59 provided on the carriage 50 is reflected by any other portion than the position detecting marks 834, the reflected light thereof does not return to a light receiving portion. Thereby, erroneous detection in the position detection of the tray 83 can be prevented.

As described above, the reflectance of the position detecting marks 834 on the tray 83 is high and therefore, it is not necessary to carry a sensor of high performance thereon, and processing such as correction can be reduced, and an increase in cost and an increase in recording time (printing time) can be avoided.

Also, as compared with a method of directly reading the edge of the printing area (recording area) of a CD, the position detection of a CD can be effected accurately even when printing is effected on a colored CD or reprinting is effected on a once printed CD.

The CD mounting portion 832 is provided with a plurality of molded claws, whereby the positioning and backlash removal when the CD is mounted are effected. The operator aligns an aperture in the central portion of the CD with the CD mounting portion 832 to thereby mount the CD. When the CD is to be removed, the operator can remove the CD by holding the outer peripheral edge of the CD by the utilization of the CD taking-out hole 835. The CD mounting portion 832 is lower by a step than the other surfaces of the tray 83. The media presence or absence detecting mark 838 is provided on that low surface. This media presence or absence detecting mark 838 is designed such that an aperture of a predetermined width is formed in a hot stamp of a predetermined width, and the absence of media is judged when the width of this aperture is detected.

As shown in FIG. 13, the tray sheet 831 is mounted on the distal end of the tray 83 in order to ensure the meshing of the tray 83 with the conveying roller 36 and the pinch rollers 37. This tray sheet 831 is formed of a sheet material consisting of PET or the like having a thickness of the order of 0.1 mm–0.3 mm, and has a predetermined coefficient of friction and hardness. Also, the tray 83 itself has a tapered portion 830 provided on the distal end portion thereof. Accordingly, the tray sheet 831 is first nipped between the conveying roller 36 and the pinch rollers 37 to thereby give birth to a conveying force, and then the tapered portion 830 at the distal end of the tray 83 raises the pinch rollers 37, whereby the thick tray 83 is nipped between the conveying roller 36 and the pinch rollers 37, whereby the accurate conveyance of the tray 83 becomes possible.

The position detecting mark 834 is provided between the pinch rollers 37. Accordingly, the position detecting mark 834 is prevented from contacting with the pinch rollers 37, whereby the surface of the position detecting mark 834 is prevented from being injured.

Referring to FIG. 19, the tray guide 82 constituting the CD conveying portion 8 is provided with a side pressure runner 824 for pressing the tray 83 as shown in FIG. 13 against the reference (not shown) of the tray guide 82, and the tray 83 is pressed against the aforementioned reference with predetermined pressure by a runner spring (not shown) to thereby effect positioning. The side pressure runner 824 acts until the operator sets the tray 83 at a predetermined position. However, when the tray 83 is conveyed by the conveying roller 36 and the pinch rollers 37, the side pressure runner escape portion 837 (FIG. 13) comes to a position whereat the side pressure roller 824 acts and therefore, the side pressure runner 824 no longer acts on the tray 83. The reason for adopting such a construction is for eliminating the fact that any extra back tension or the like acts on the tray 83, to thereby prevent the lowering of the conveying accuracy of the tray 83.

As shown in FIG. 19, the slide cover 81 is provided with right and left pressing runners 811, and the tray 83 is pressed against the sheet discharging roller 41 with predetermined pressure by the aforementioned runner spring to thereby give birth to a conveying force for the tray 83. By this conveying force, at the start of recording (printing), the tray 83 can be conveyed from a set position to the nip portion between the conveying roller 36 and the pinch rollers 37. Further, at the end of the recording (printing), the tray 83 can be conveyed to a predetermined position in which the operator takes out the tray. Again in this case, the position of the position detecting mark 834 and the position of the pressing runner 811 are designed to differ from each other, whereby the position detecting mark 834 is prevented from contacting with the pressing runner 811 to thereby injure the surface thereof.

By drawing out the tray 83 conveyed to the predetermined position, it is possible to take out the tray 83 from the tray guide 82. Further, by utilizing the CD taking-out holes 835 at two locations, the operator can remove the CD by holding the outer peripheral edge of the CD.

Description will now be made of the operation when recording is effected on the CD by the recording apparatus having the above-described construction.

First, the CD conveying portion 8 is slidden straight toward the main body of the recording apparatus 1 and is mounted in the lower case 99. At this time, it is detected by the tray guide detecting sensor 344 (FIG. 8) that the tray guide 82 has been mounted on the main body of the recording apparatus. When the slide cover 81 is then moved toward the main body of the recording apparatus, the arm 85 protrudes toward the main body of the recording apparatus in operative association with the slide cover 81, as shown in FIG. 10. The arm 85 then comes into between the spur base 43 and the platen 34 to thereby upwardly raise the spur base 43 by a predetermined amount.

Design is made such that when the slide cover 81 is moved toward the main body of the recording apparatus as described above, the slide cover 81 is moved obliquely upwardly and therefore, an opening portion 821 (FIG. 6B) is formed between the slide cover and the tray guide 82. In this state, as shown in FIG. 16, the tray 83 loaded with a CD can be inserted through the opening portion 821 to thereby set the tray 83 at a predetermined position.

The CD is then mounted on the CD mounting portion 832 (FIG. 13) of the tray 83. The operator holds the operating portion 833 (FIG. 13) and inserts the tray 83 until the insertion aligning mark 836 (FIGS. 13 and 16) coincides with the tray set mark 826 (FIG. 16) of the tray guide 82.

When in this state, a recording signal (a printing signal or an image signal) is transmitted from a host computer, the recording operation (printing operation) is started. First, as shown in FIG. 17, the conveying roller 36, the sheet discharging roller 40 and the sheet discharging roller 41 are rotated in a reverse direction. That is, in FIG. 17, the tray 83 is pressed against the sheet discharging roller 40 and the sheet discharging roller 41 with predetermined pressure by a pressing runner (the reference numeral 811 in FIG. 19) and a runner spring (not shown) to thereby give birth to the conveying force for the tray 83 and therefore, the tray 83 is conveyed to the interior of the recording apparatus in conformity with the reverse rotation of the first sheet discharging roller 40 and the second sheet discharging roller 41.

The tray sheet 831 (FIG. 13) on the distal end portion of the tray 83 is nipped between the conveying roller 36 and the pinch rollers 37, whereby a predetermined conveying force is born, and the tapered portion 830 of the distal end portion of the tray 83 raises the pinch rollers 37, whereby the tray 83 is nipped between the conveying roller 36 and the pinch rollers 37.

Next, the carriage 50 carrying the recording head 7 thereon is moved from its home position to a recording area (printing area) to detect the tray 83. At this time, as shown in FIGS. 18A and 18B, the carriage lifting motor 58 (FIG. 3) is operated to thereby move up the guide shaft 52, and an optimum gap (sheet interval distance) can be formed between the recording head 7 and the tray 83.

Figure 15A:
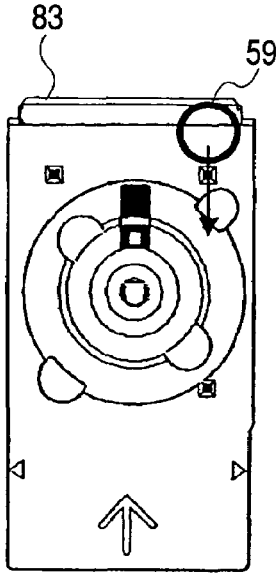
FIGS. 15A, 15B, 15C, 15D, 15E and 15F are typical plan views showing the various states of the relative position of the tray of FIG. 13 and a tray position detecting sensor.
Figure 15B:
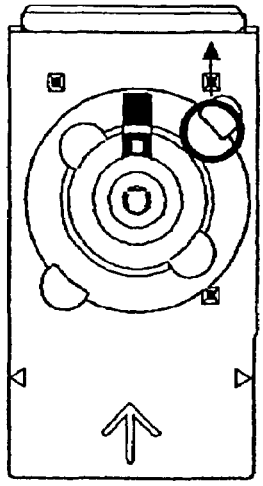

As shown in FIGS. 15A and 15B, the carriage 50 is stopped with the tray position detecting sensor (imaginarily indicated by a circle in FIGS. 15A to 15F) 59 thereon adjusted to the position of the position detecting mark 834*a* (FIG. 13) of the tray 83. Then The tray 83 is conveyed and the edge position of the upper end (distal end) of the position detecting mark 834*a* is detected. The conveyance is intactly continued and the lower end edge (rear end edge) of the position detecting mark 834*a* is detected.

Figure 15C:
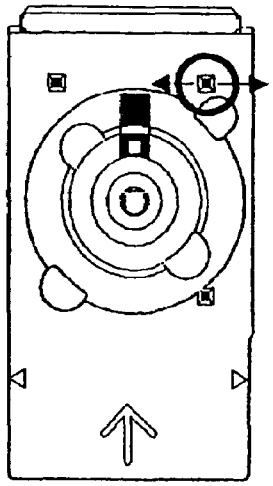

Next, as shown in FIG. 15C, the tray 83 is returned so that the tray position detecting sensor 59 on the carriage 50 may come to substantially the center of the position detecting mark 834*a* of the tray 83. The carriage 50 is then moved to the right and left to thereby detect the edge position of the right end and the edge position of the left end of the position detecting mark 834*a*. Thereby, the central position 834*ac* (FIG. 13) of the position detecting mark 834*a* can be calculated, and from this central position 834*ac*, the accurate recording position (printing position) of the CD carried on the tray 83 can be found. As described above, in the present embodiment, the detection of the position of the tray 83 itself is effected and therefore, as compared with a case where detection is not effected but printing is effected with mechanical accuracy alone, it is possible to eliminate the disadvantage that the recording position (printing) for the CD deviates under the influence of the unevenness of the accuracy of parts and the state or the like of the tray.

Figure 15D:
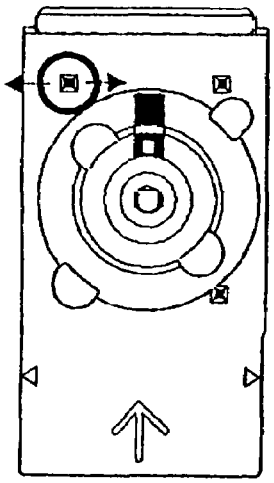
Figure 15E:
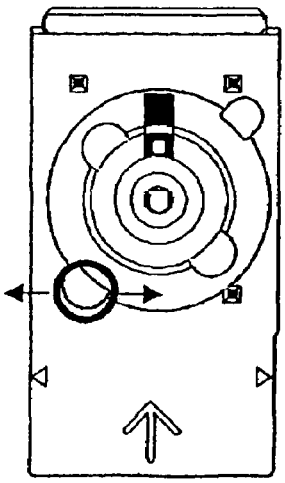

After the position (central position) of the position detecting mark 834*a* of the tray 83 has been detected, the carriage 50 is moved to detect the position detecting mark 834*b*, as shown in FIG. 15D. By detecting the edges of the opposite ends of this position detecting mark 834*b*, it is confirmed that the previously detected position detecting mark 834*a* is correct. The reason why such an operation is performed is for enabling, when the tray 83 has been inserted more deeply than a regular set position, even if the position of the position detecting mark 834*c* is detected as shown in FIG. 15E, it to be detected that the position detecting mark 834*c* is not the position detecting mark 834*a*, by the operation of moving the carriage to detect the position detecting mark 834*b*.

Figure 15F:
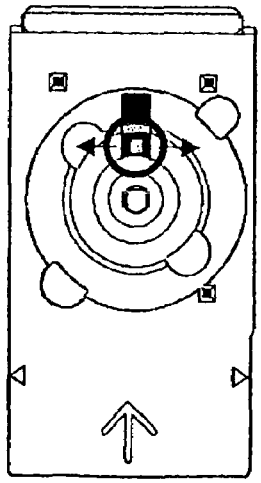

After the position of the tray 83 has been detected, as shown in FIG. 15F, the tray 83 is conveyed in the conveying direction thereof so that the position of the tray position detecting sensor 59 of the carriage 50 and the position of the media presence or absence detecting mark 838 (FIG. 13) of the tray 83 may coincide with each other.

When at this time, the edge of the detection hole of the media presence or absence detecting mark 838 is detected and coincides with a predetermined hole width, it is judged that the CD is not carried, and the recording operation (printing work) is interrupted, and the tray 83 is discharged to a predetermined position, and an error is displayed. If here, the media presence or absence detecting mark 838 cannot be detected, it is judged that the CD is carried, and the recording operation is continued.

When the above-described series of initial operations have been terminated, the entire CD in the inner part of the recording apparatus (such as a printer) is conveyed to a predetermined position at which recording (printing) can be effected. Thereafter, recording (printing) is started in conformity with recording data sent from the host computer. Regarding an image to be recorded, use can be made of so-called multipass recording (printing) for forming an image by a plurality of scans, to thereby mitigate the uneven band or the like of a recorded image due to the conveyance accuracy of the CD and the shooting accuracy of the recording head 7.

After recording (printing) has been terminated the tray 83 is conveyed to a position at which the operator has set the tray 83 on the tray guide 82 before the aforedescribed printing. In this state, the operator can take out the tray 83 on which the CD subjected to printing is carried. Further, the operator pulls the slide cover 81 toward this side (moves it away from the main body of the recording apparatus), whereby the arm 85 is released from the spur base 43 and the hooks 84 are released from the lower case 99, whereby the CD conveying portion 8 can be released and removed from the main body of the recording apparatus.

By the above-described construction and operation (action) of the recording apparatus (image forming apparatus), recording (printing) can be effected simply and accurately on the CD.

(Description of the Major Portions of the Present Invention)

Description will now be made of the major portions of the present invention for moving up and down the code strip 561 in conformity with the upward and downward movement of the guide shaft 52.

Figure 20A:
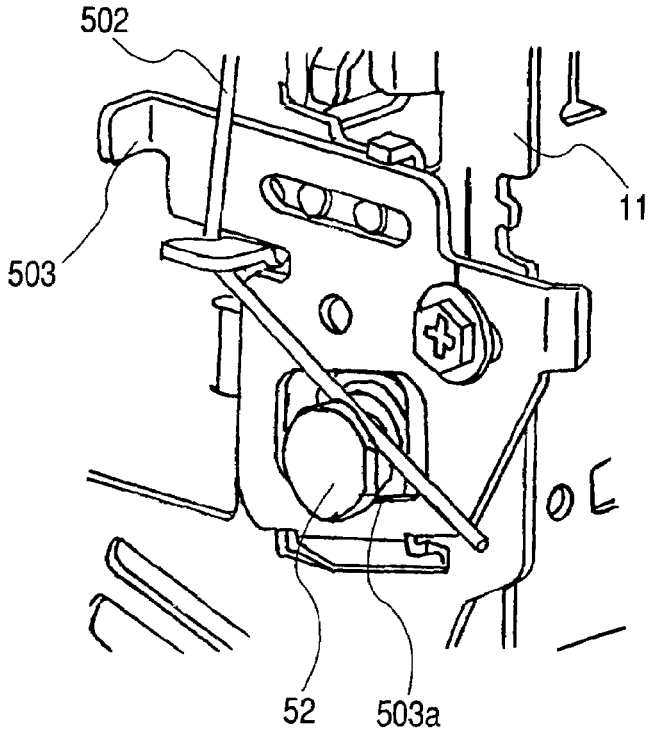
FIG. 20A is a fragmentary perspective view showing the ordinary supporting state of the left side of the guide shaft of the guide shaft lifting means of the recording apparatus to which the present invention is applied.
Figure 20B:
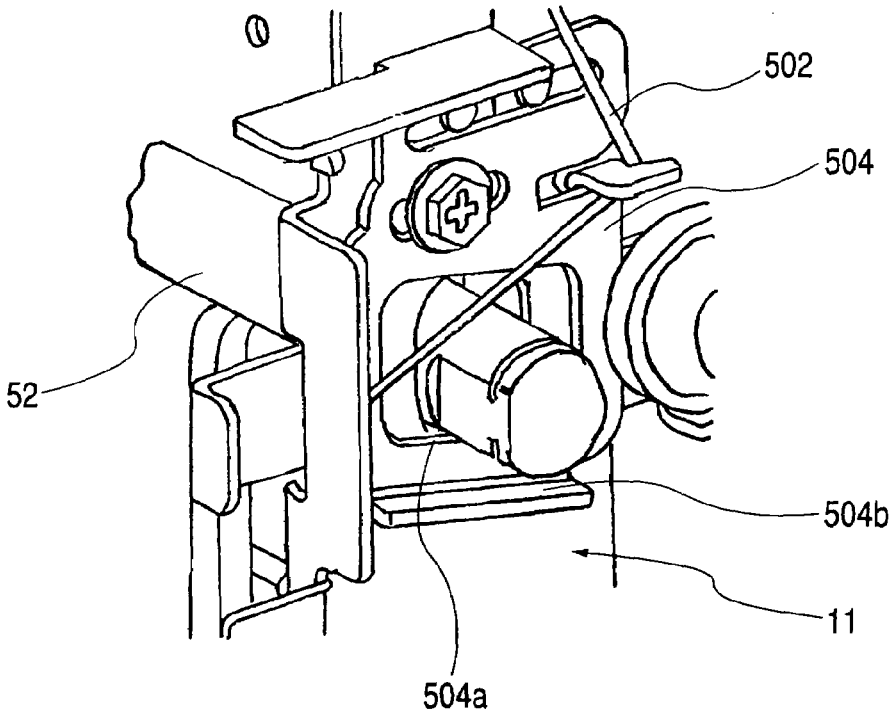
FIG. 20B is a fragmentary perspective view showing the ordinary supporting state of the right side of the guide shaft.
Figure 21A:
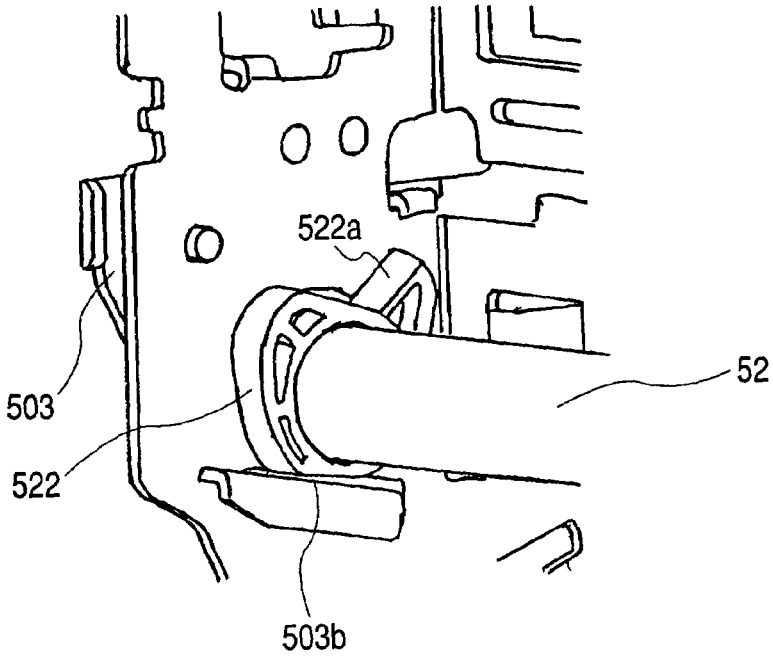
FIG. 21A is a fragmentary perspective view showing a state in which an eccentric cam is mounted in the ordinary supporting state of the left side of the guide shaft of the guide shaft lifting means for moving up and down the guide shaft of the recording apparatus to which the present invention is applied.
Figure 21B:
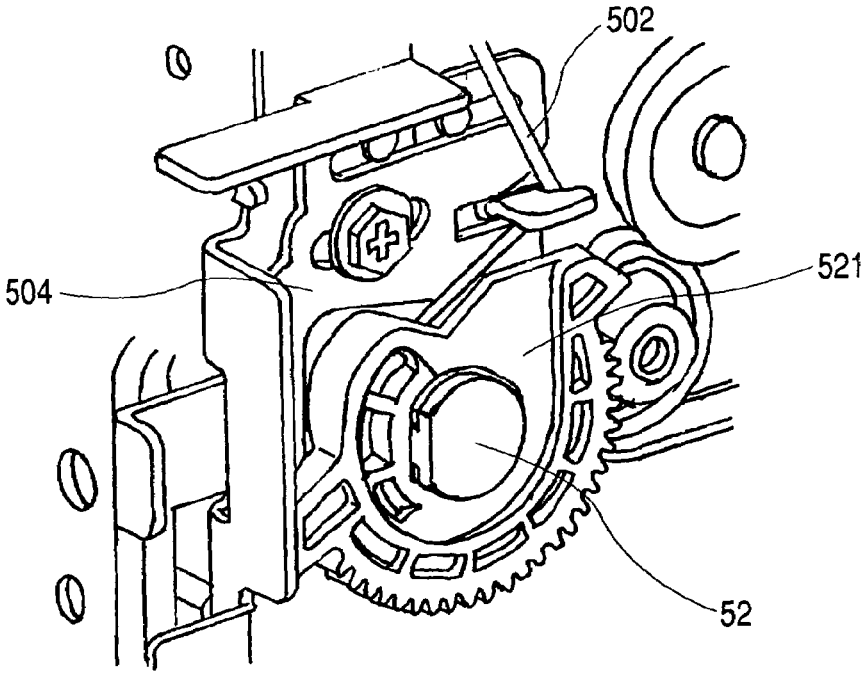
FIG. 21B is a fragmentary perspective view showing a state in which an eccentric cam is mounted in the ordinary supporting state of the right side of the guide shaft.
Figure 22:
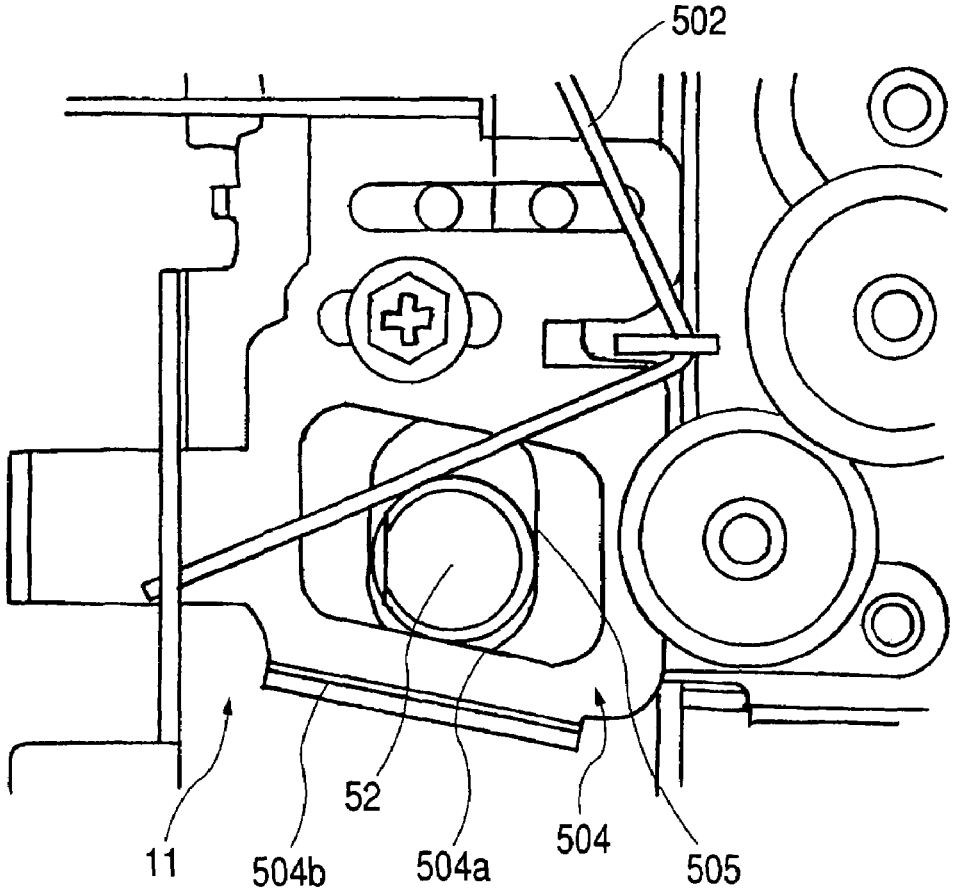
FIG. 22 is a fragmentary perspective view showing the ordinary supporting state of the right side of the guide shaft of the guide shaft lifting means of the recording apparatus to which the present invention is applied.
Figure 23A:
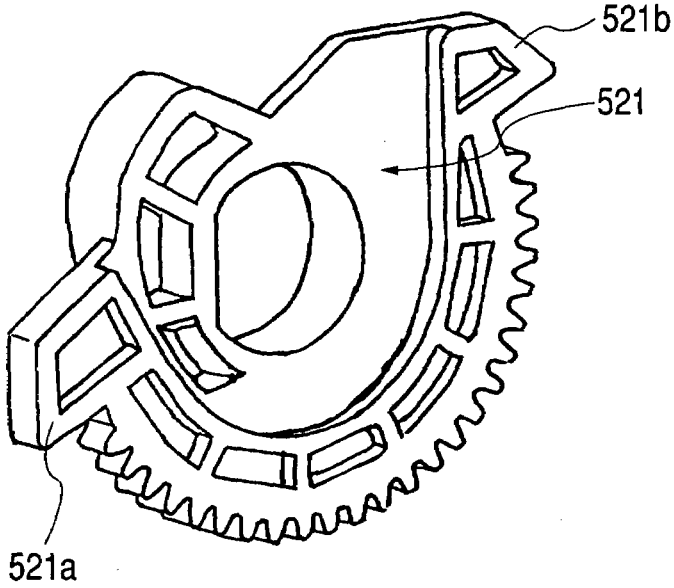
FIGS. 23A and 23B are perspective views typically showing the eccentric cam of the guide shaft lifting means of the recording apparatus to which the present invention is applied as it is seen from its inside and outside.
Figure 23B:
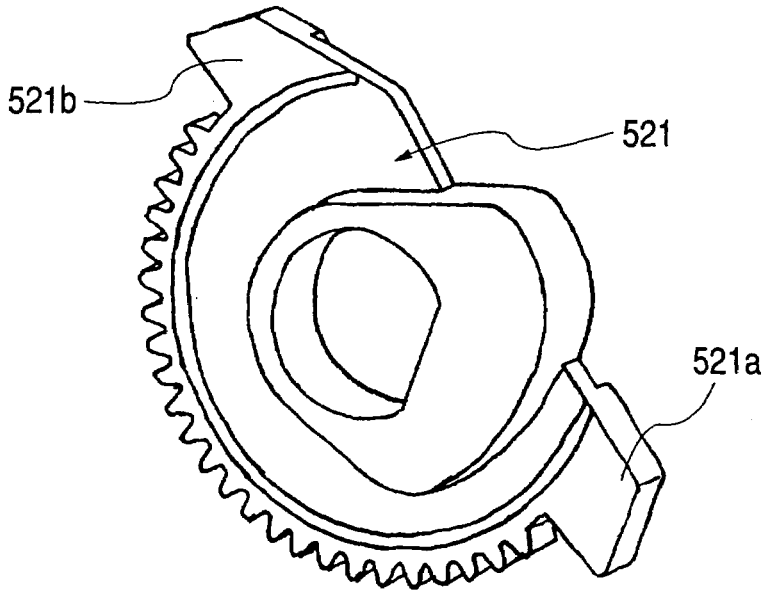

FIGS. 20A and 21A are fragmentary perspective views showing a state in which an eccentric cam is mounted in the ordinary supporting state of the left side of the guide shaft of the guide shaft lifting means to move up and down the guide shaft 52 of he recording apparatus to which the present invention is applied. FIGS. 20B and 22 are fragmentary perspective views showing the ordinary supporting state of the right side of the guide shaft of the guide shaft lifting means of the recording apparatus to which the present invention is applied. FIG. 21B is a fragmentary perspective view showing a state in which the eccentric cam is mounted in the ordinary supporting state of the right side of the guide shaft of the guide shaft lifting means of the recording apparatus to which the present invention is applied. FIGS. 23A and 23B are perspective views typically showing the eccentric cam 521 of the guide shaft lifting means of the recording apparatus to which the present invention is applied as it is seen from its opposite sides.

Description will now be made of an embodiment of the recording apparatus to which the present invention is applied in which the code strip 561 is moved up and down.

In FIGS. 20A and 20B to 22, the height position of the guide shaft 52 during ordinary recording (ordinary printing) (the height position of the carriage 50 for regulating the interval between the recording head 7 and the sheet material P or the CD as a recording material) is determined by a gap adjusting member L (sheet interval adjusting plate L) 503 and a gap adjusting member R (sheet interval adjusting plate R) 504. Also, the position of the guide shaft 52 in the conveying direction of the recording material is determined by the guide shaft 52 being biased by a guide shaft spring 502 toward the vertical surface 505 (FIG. 22) of the chassis 11 which provides the skeleton of the recording apparatus. Therefore, design is made such that even if the height of the guide shaft 52 is changed, the position of the guide shaft 52 in the conveying direction of the recording material is not changed, but is always accurately determined at a predetermined position by the vertical surface 505 of the chassis 11 which provides the skeleton of the recording apparatus.

Both of the guide shaft (lower surface) supporting portion 503*a* of the sheet interval adjusting plate L (gap adjusting member L) 503 and the guide shaft (lower surface) supporting portion 504*a* of the sheet interval adjusting plate R (gap adjusting member R) 504 are inclined surfaces, and are designed to be capable of finely adjust the height (the ordinary printing height, the lowest height position and the initial height position) of the guide shaft 52 during ordinary recording by the sheet interval adjusting plate L 503 and the sheet interval adjusting plate R 504 being slidden forward and backward. Also, both of the sheet interval adjusting plate L 503 and the sheet interval adjusting plate R 504 are provided with eccentric cam dashing portions (cam dashing surfaces) 503*a* and 504*b* parallel to guide shaft supporting portions 503*a* and 504*a*, respectively. An eccentric cam R 521 is provided on the right end of the guide shaft 52 (FIG. 21B), and the eccentric cam R 521 has a cam surface and a gear portion, and design is made such that drive (pivotal movement) is transmitted from the carriage lifting motor 58 to the gear portion through a driving gear train.

That is, design is made such that the pivotally moved position of the eccentric cam R 521 is controlled by the carriage lifting motor 58, whereby the height position of the guide shaft 52 (the sheet interval distance (gap) of the recording head 7 to the recording material) can be adjusted.

Also, an eccentric cam L 522 is provided at a location inside the chassis 11 on the left end portion of the guide shaft 52 (FIG. 21A), and the eccentric cam L 522 is provided with a rotation regulating portion L 522*a* for dashing against the carriage 50 and regulating the rotation of the eccentric cam L 522.

Figure 24A:
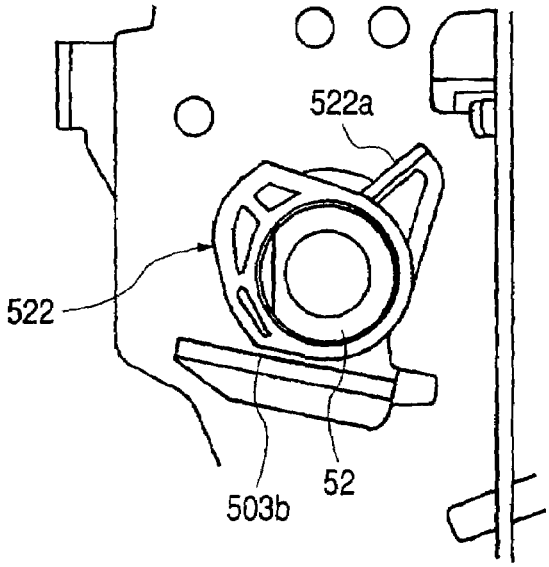
FIG. 24A is a side view typically showing the height position (usually the printing height) of an eccentric cam L during ordinary recording.
Figure 24B:
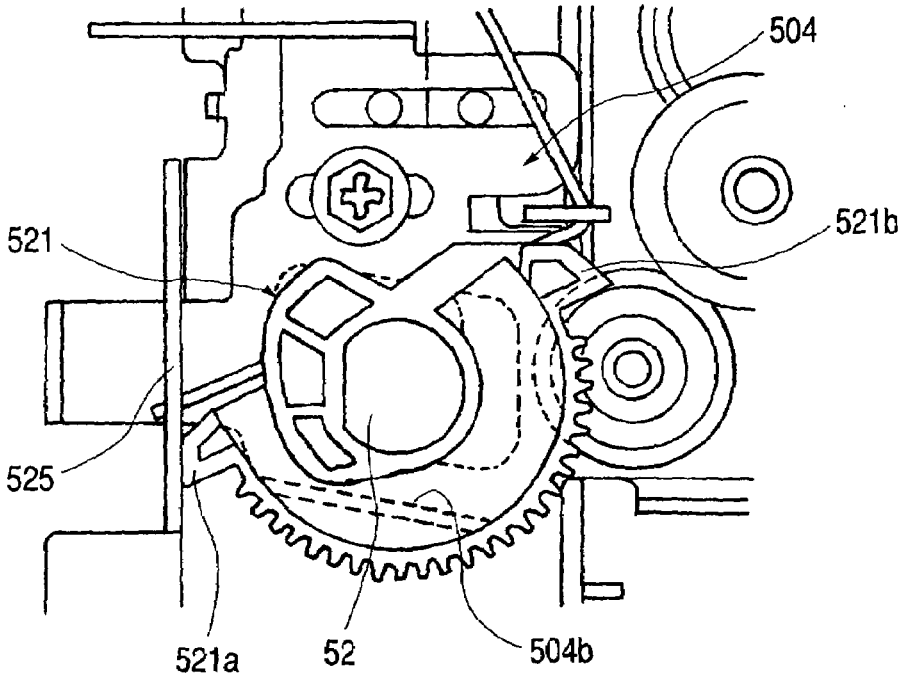
FIG. 24B is a side view typically showing the height position (usually the printing height) of an eccentric cam R during ordinary recording.

FIG. 24A is a side view typically showing the height position (ordinary printing height) of the eccentric cam L 522 during ordinary recording, and FIG. 24B is a side view typically showing the height position (ordinary printing height) of the eccentric cam R 521 during ordinary recording.

Figure 25A:
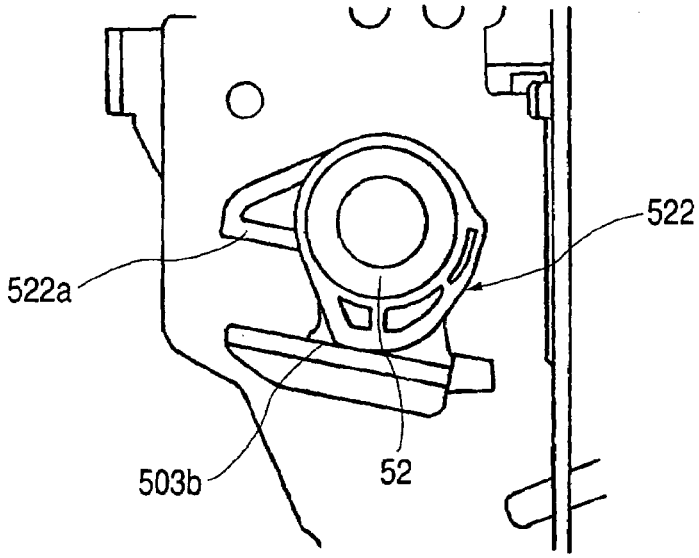
FIG. 25A is a side view typically showing the height position (CD printing height) of the eccentric cam L during CD printing.
Figure 25B:
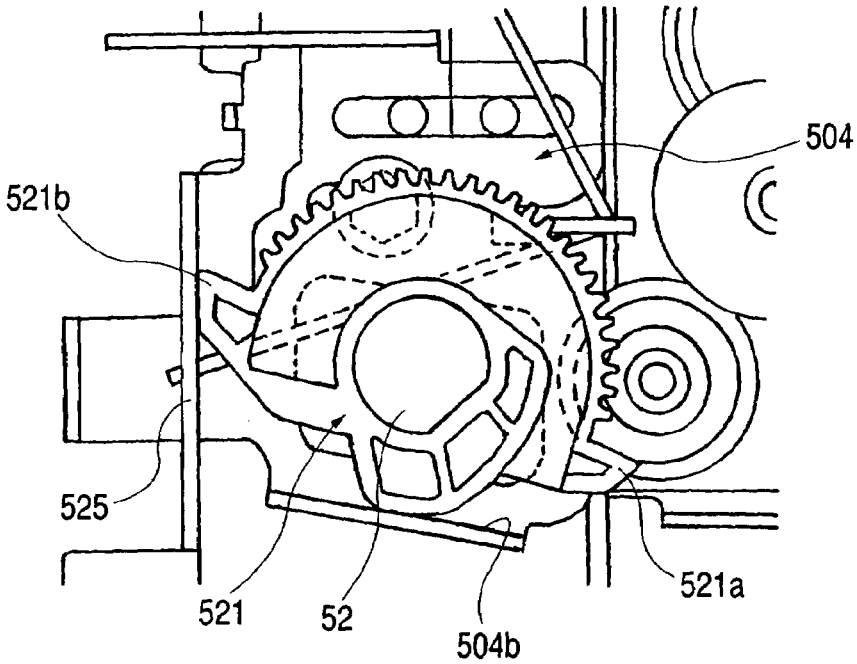
FIG. 25B is a side view typically showing the height position (CD printing height) of the eccentric cam R during CD printing.

FIG. 25A is a side view typically showing the height position (CD printing height) of the eccentric cam L 522 during CD printing, and FIG. 25B is a side view typically showing the height position (CD printing height) of the eccentric cam R 521 during CD printing.

Usually, at the height position during recording (usually the printing height position, the lowest height position and the initial height position), the cam surfaces of the eccentric cam L 522 and the eccentric cam R 521 are not in contact with the eccentric cam dashing portions 503 and 504*b* of the gap adjusting member L (sheet interval adjusting plate L) 503 and the gap adjusting member R (sheet interval adjusting plate R) 504, respectively, and the guide shaft 52 (the lower surface thereof) has its opposite end portions supported by guide shaft (lower surface) supporting portions 503*a* and 504*a* as the lowest height prescribing portions, whereby the guide shaft is positioned in the height direction thereof. Also, the rotated position of the eccentric cam R 521 is determined by the rotation regulating portion 521*a* being dashed against the chassis dashing portion 525 (FIG. 24B) of the chassis 11.

Description will now be made of a case where recording is effected on the CD.

From a state as shown in FIGS. 24A and 24B wherein the guide shaft 52 is in the height position during ordinary recording (the ordinary printing height, and in the present embodiment, the lowest height position or the initial height position), the carriage lifting motor 58 which is a DC motor is given an electric current for a predetermined time and is rotated, whereby the eccentric cam R 21 is rotated counterclockwisely as viewed from the right side of the recording apparatus as shown in FIG. 24B. The cam surfaces of the eccentric cams R and L dash against the cam dashing portions (cam dashing surfaces) 503*b* and 504*b* of the gap adjusting members L and R (sheet interval adjusting plates L and R) 503 and 504, respectively, whereby the height position of the guide shaft 52 begins to rise. Then, as shown in FIG. 25B, the rotation regulating portion 521*b* of the eccentric cam R 521 dashes against the chassis dashing portion 525, whereby the rotated position of the eccentric cam R 521 is determined.

As the result, the eccentric cam L 522 assumes a state as shown in FIG. 25A, and the eccentric cam R 521 assumes a state as shown in FIG. 25B. That is, the guide shaft 52 (the carriage 50 and the recording head 7) assumes a CD printing height position (a height position forming an optimum sheet interval interval for recording on the CD), and a gap appropriate for effecting recording on the CD on the tray 83 can be formed.

At this time, the position of the guide shaft 52 in the conveying direction of the recording material is determined at a predetermined position by the vertical surface 505 (FIG. 22) of the chassis 11 and therefore, even if the guide shaft 52 is moved up from an ordinary printing height position (the lowest height position or the initial position in the present embodiment) to the CD printing position, the position of the guide shaft 52 in the conveying direction of the recording material does not change, but is maintained in a state positioned by the chassis 11.

Also, the encoder sensor (not shown) at this time is mounted on the carriage portion 5 and therefore is moved to the CD printing height position with the carriage 50. If the code strip 561 remains in the ordinary position, the code strip 561 will come off from the reading position of the aforementioned encoder sensor and the position of the carriage portion 5 will become incapable of being detected. Therefore, in the present invention, design is made such that with the upward movement of the carriage 50, the code strip 561 is also raised with respect to the vicinity of the aforementioned encoder sensor. This construction will now be described with reference to FIGS. 28 and 29.

Figure 28:
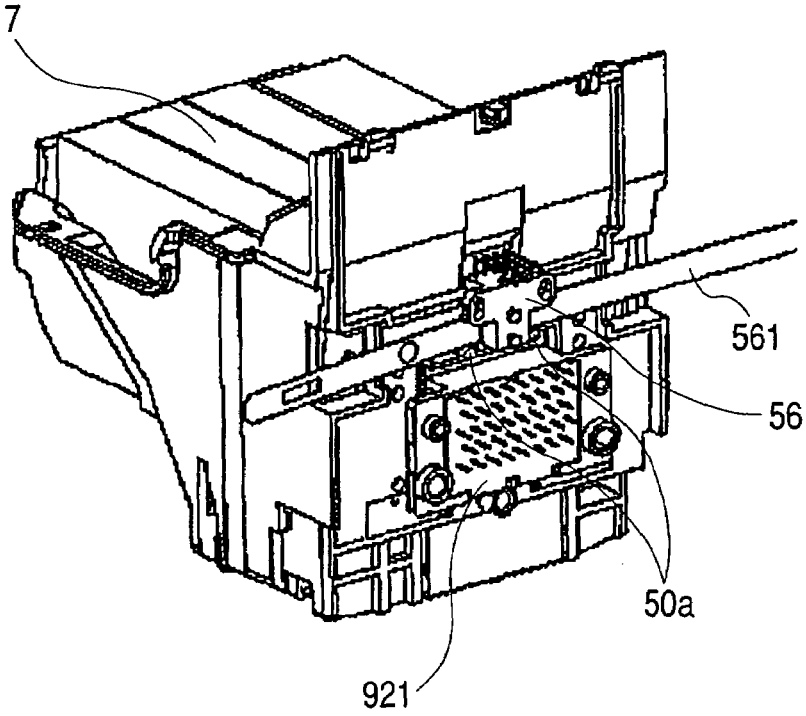
FIG. 28 is a perspective view showing a state in which a carriage board has been removed from the carriage portion of the recording apparatus to which the present invention is applied.
Figure 29:
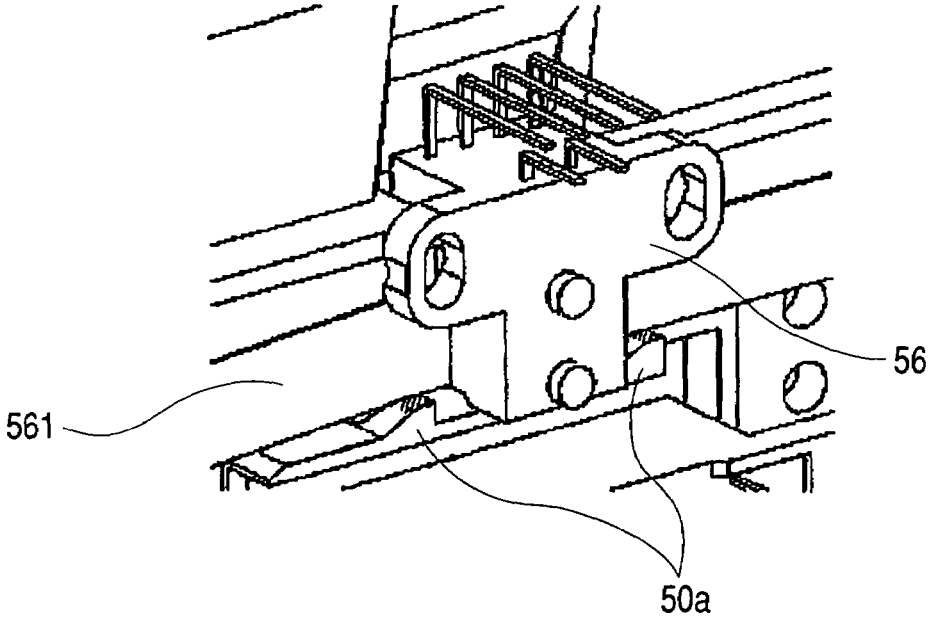
FIG. 29 is a partly enlarged view of the carriage in the state shown in FIG. 28.

FIG. 28 shows a state in which a carriage board (not shown) has been detached from the carriage portion 5 and a carriage board connecting portion 921 has appeared, and FIG. 29 is a view in which only the vicinity of the encoder sensor 56 of FIG. 28 is enlarged. In FIGS. 28 and 29, the reference character 50*a* designates a portion of the carriage 50 which is a strip lift portion located near the encoder sensor 56.

The code strip 561 has one end thereof fixed to the chassis 11, and has the other end thereof mounted while being given tension by a resilient member such as a spring, not shown. When the carriage 50 is at the height position during ordinary recording, the strip lift portion 50*a* does not contact with the code strip 561. Normally, it operates with a gap of the order of 1 mm.

Also, when the carriage 50 is moved to the CD printing height position, the encoder sensor 56 is moved by the same height. A strip lift portion 50*a* formed integrally with the carriage 50 is also moved by the same height and at this time, the strip lift portion 50*a* contacts with the lower end of the code strip 561. The hatched portion of the strip lift portion 50*a* (FIG. 29) raises the code strip 561 by an amount corresponding to the difference 2 mm between the raised amount (3 mm) of the CD printing height position and the standard gap (1 mm). That is, the upward and downward movement of the code strip 561 is effected only near the encoder sensor 56. As the result, the code strip 561 having one end thereof mounted on the chassis 11 and the other end thereof mounted with tension applied thereto by the spring, not shown, as previously described, becomes obliquely mounted with the encoder sensor 56 as the vertex. This oblique component, however, is an amount sufficiently negligible relative to the bar pitch of the code strip, and poses no problem in operation. The code strip 561 is not deformed by the raising of the strip lift portion 50*a*.

When the recording on the CD is terminated and the guide shaft 52 is to be returned to the ordinary printing height position (the lowest height position or the initial height position in the present embodiment), an electric current is given to the carriage lifting motor 58 for a predetermined time to thereby rotate the carriage lifting motor 58 from the CD printing height position, thereby rotating the eccentric cam R 521 clockwisely as viewed from the right side shown in FIG. 25B. Since as previously described, the eccentric cam R 521 and the eccentric cam L 522 are fixed to the opposite end portions of the guide shaft 52 in the rotational direction thereof, the guide shaft 52 and the eccentric cam L 522 are likewise rotated in the clockwise direction in synchronism with the rotation of the eccentric cam R 521 in the clockwise direction.

Then the cam surfaces of the eccentric cams R and L being to move down along the cam dashing portions (cam dashing surfaces) 503*b* and 504*b* of the sheet interval adjusting plates L and R (the intervals between the axis of the guide shaft 52 and the cam dashing portions 503*b* and 504*b* of the sheet interval adjusting plates L and R begin to decrease), and the height position of the guide shaft 52 begins to lower. Then, again as shown in FIG. 24B, the rotation regulating portion 521*a* of the eccentric cam R 521 dashes against the chassis dashing portion 525, whereby the rotated position of the eccentric cam R 521 is determined and the guide shaft is returned to the ordinary printing height position (the position shown in FIGS. 24A and 24B, or the lowest height position in the present embodiment). At this time, the strip lift portion 50*a* and the code strip 561 are also returned to a state in which they have a gap of the order of 1 mm, as in the initial state.

Figure 26A:
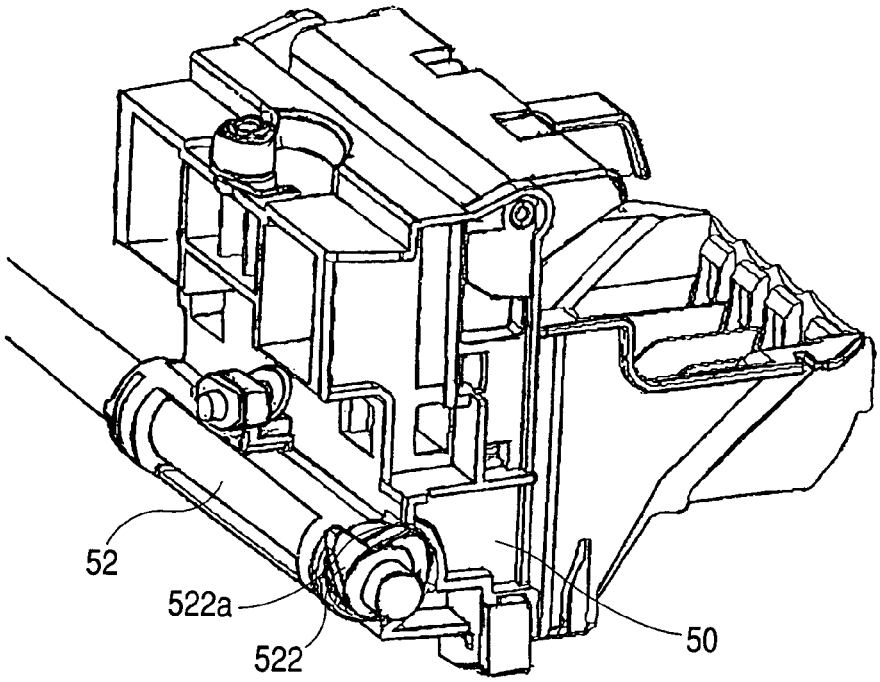
FIG. 26A is a perspective view showing a state in which in the recording apparatus to which the present invention is applied to eccentric cam L is pivotally moved to an ordinary printing height position by the utilization of the carriage.
Figure 26B:
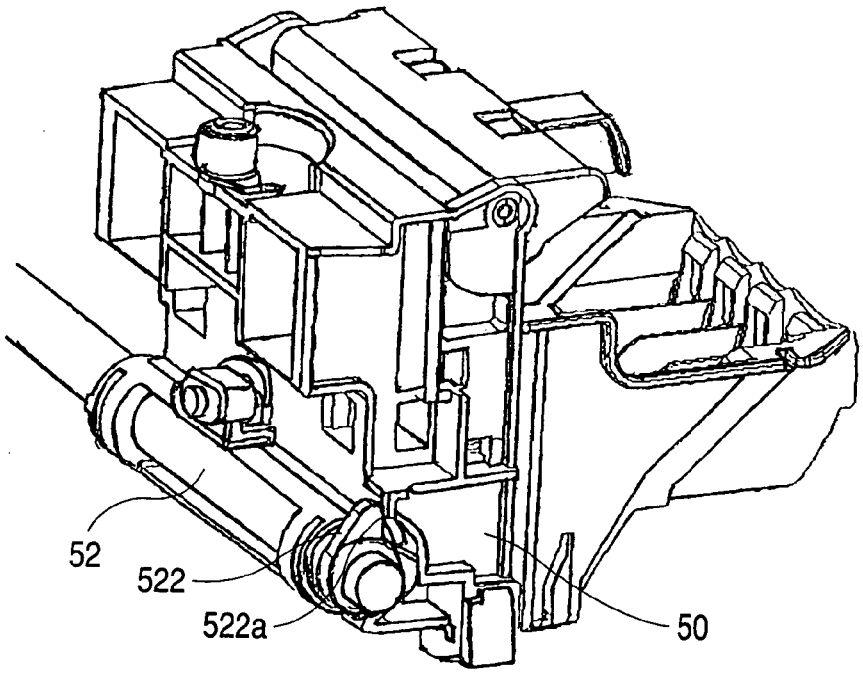
FIG. 26B is a perspective view showing a state in which the eccentric cam L is pivotally moved from the ordinary printing height position to a thick paper printing height position.

FIGS. 26A and 26B are perspective views showing a state in which in the recording apparatus to which the present invention is applied, the eccentric cam L is pivotally moved from the ordinary printing height position (FIG. 26A) to a thick paper printing height position (FIG. 26B) by the utilization of the carriage.

Figure 27A:
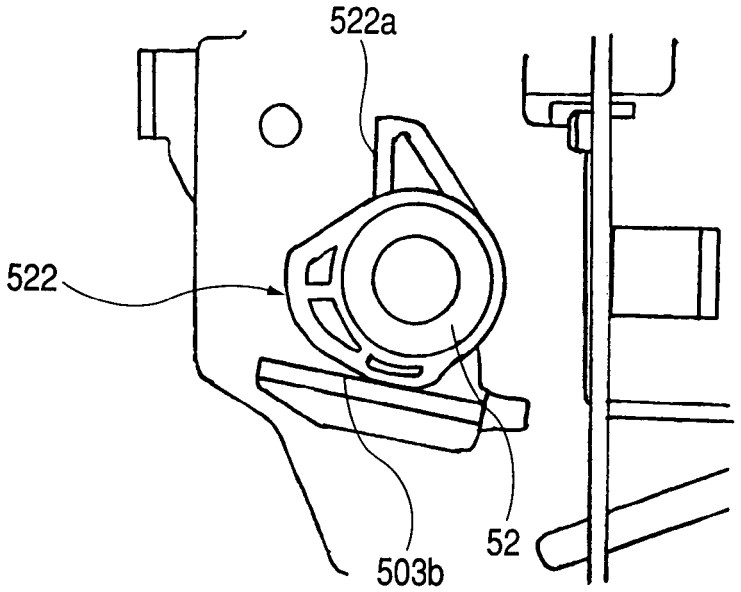
FIG. 27A is a side view typically showing the height position (thick paper printing height) of the eccentric cam L during thick paper printing.
Figure 27B:
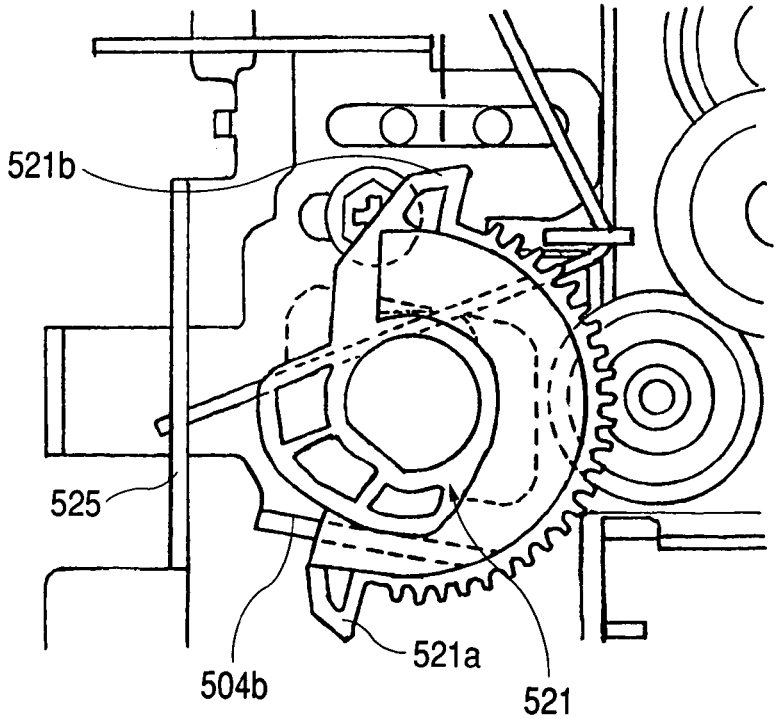
FIG. 27B is a side view typically showing the height position (thick paper printing height) of the eccentric cam R during thick paper printing.

FIG. 27A is a side view typically showing the height position of the eccentric cam L 522 during thick paper printing (thick paper printing height), and FIG. 27B is a side view typically showing the height position of the eccentric cam R 521 during thick paper printing (thick paper printing height).

Description will subsequently be made of a case where the carriage 50 (guide shaft 52) is moved up from the ordinary printing height position (the lowest height position in the present embodiment) to the thick paper printing height position lower than the CD printing height position.

First, the carriage 50 is set at the ordinary printing height position as shown in FIGS. 24A and 24B. Then, as shown in FIG. 26, the carriage 50 is moved to a changeover position near the eccentric cam L 522 at the left end of the guide shaft 52. Then, an electric current is given to the carriage lifting motor 58 for a predetermined time to thereby rotate this carriage lifting motor 58, thereby rotating the eccentric cam R 521 in a counter-clockwise direction as viewed from the right side shown in FIG. 24B. Thereupon, with the guide shaft 52, the eccentric cam L 522 is also rotated in the same direction, and is rotated from the state shown in FIG. 26A to the state shown in FIG. 26B, whereby the rotation regulating portion L 522*a* of the eccentric cam L 522 dashes against the carriage 50.

Thereby, the eccentric cam L 522 is positioned in the state as shown in FIG. 27A (the state of the intermediate position between FIG. 24A and FIG. 25A), and the eccentric cam R 521 is positioned in the state as shown in FIG. 27B (the state of the intermediate position between FIG. 24B and FIG. 25B). Thus, the carriage 50 (guide shaft 52) can be moved up to the thick paper printing height position which is a height position lower than the CD printing position.

At this time, the position of the guide shaft 52 in the conveying direction of the recording material is determined at a predetermined position by the vertical surface 505 (FIG. 22) of the chassis 11 and therefore, even if the guide shaft 52 is moved up from the ordinary printing height to the thick paper printing height lower than the CD printing height, the position of the guide shaft 52 in the conveying direction of the recording material does not change, but is maintained as it is determined by the chassis 11.

As described above, design is made such that in the case of the height position during ordinary recording, the strip lift portion 50*a* does not contact with the code strip 561, but only when the carriage 50 has been moved to the CD printing height position, the strip lift portion 50*a* contacts with the lower end of the code strip 561 to thereby move the code strip 561 by an amount necessary for the reading of the encoder 56 and therefore, there can be provided an apparatus which operates as a printer of high quietude which does not make a sliding sound in the case of the height position during ordinary recording, and which makes more or less sliding sound only during CD printing low in the frequency of use, but is inexpensive.

While in the foregoing embodiment, description has been made with a case where the recording apparatus is an ink jet recording apparatus taken as an example, the present invention can likewise be applied to such recording apparatuses using other recording methods as recording apparatuses of the wire dot type, the thermosensitive type and the laser beam type, and can achieve a similar operational effect. The present invention can also be applied to a recording apparatus for effecting single-color recording, a color recording apparatus for recording in a plurality of different colors by the use of one or more recording heads, a gradation recording apparatus for recording in one and the same color but with a plurality of degrees of density, and further a recording apparatus comprising a combination of these, and can achieve a similar effect.

Also, the present invention can likewise be applied to the case of any arrangement and construction of a recording head and an ink tank, such as a construction using an interchangeable head cartridge comprising a recording head and an ink tank made integral with each other in the case of an ink jet recording apparatus for recording by the use of liquid ink, or a construction in which a recording head and an ink tank are made discrete from each other and are connected together by an ink supplying tube or the like, and can obtain a similar effect.

Further, the present invention can also be applied to ink jet recording apparatuses using, for example, recording means using an electro-mechanical conversion member such as a piezoelectric element, and above all, brings about an excellent effect in an ink jet recording apparatus using recording means of a type discharging ink by the utilization of thermal energy. This is because according to such a type, the higher density and higher definition of recording can be achieved.

What is claimed is:

1. A recording apparatus comprising:

a carriage carrying a recording head thereon and scanning along a recording material;

a sensor disposed on said carriage for detecting a scanning position of said carriage;

a code strip to be read by said sensor;

a guide shaft providing a guide for the scanning of said carriage; and a lifting mechanism for moving said guide shaft up and down to thereby change a height position of said carriage, wherein when said guide shaft is moved up and down, said carriage makes contact with a lower end portion of said code strip to thereby move said code strip up and down.

2. A recording apparatus according to claim 1, wherein in a state in which said carriage is at an ordinary height, said carriage and the lower end portion of said code strip do not contact with each other.

3. A recording apparatus according to claim 1, wherein said code strip has one end thereof mounted with tension given thereto by a resilient member.

4. A recording apparatus according to claim 1, wherein upward and downward movement of said code strip is effected only near said sensor.

5. A recording apparatus according to claim 1, wherein said position detecting sensor comprises a photosensor.

6. A recording apparatus according to claim 1, wherein when said carriage is at a CD printing height, said carriage makes contact with the lower end portion of said code strip.

* * * * *

UNITED STATES PATENT AND TRADEMARK OFFICE

CERTIFICATE OF CORRECTION

PATENT NO. : 7,014,293 B2
APPLICATION NO. : 10/646893
DATED : March 21, 2006
INVENTOR(S) : Yasuhiko Ikeda et al.

It is certified that error appears in the above-identified patent and that said Letters Patent is hereby corrected as shown below:

COLUMN 1:
Line 16, “there” should read --these--.

COLUMN 2:
Line 8, “cam” should read --can--.

COLUMN 7:
Line 19, “from the” should read --the--.
Line 27, “1501 pi” should read --150 dpi--.
Line 67, “1501 pi” should read --150 dpi--.

COLUMN 8:
Line 35, “cam” should read --can--.

COLUMN 10:
Line 1, “value” should read --valve--.
Line 28, “value” should read --valve--.
Line 48, “about” should read --abut--.

COLUMN 13:
Line 30, “distriminate” should read --discriminate--.

COLUMN 16:
Line 2, “The” should read --the--.

COLUMN 17:
Line 22, “he” should read --the--.
Line 63, “adjust” should read --adjusting--.

COLUMN 19:
Line 9, “interval interval” should read --interval--.

UNITED STATES PATENT AND TRADEMARK OFFICE

CERTIFICATE OF CORRECTION

PATENT NO. : 7,014,293 B2
APPLICATION NO. : 10/646893
DATED : March 21, 2006
INVENTOR(S) : Yasuhiko Ikeda et al.

It is certified that error appears in the above-identified patent and that said Letters Patent is hereby corrected as shown below:

COLUMN 20:
Line 19, "being" should read --begin--.

Signed and Sealed this

Twenty-sixth Day of June, 2007

JON W. DUDAS
*Director of the United States Patent and Trademark Office*